US008969701B1

(12) United States Patent
Dixon

(10) Patent No.: US 8,969,701 B1
(45) Date of Patent: Mar. 3, 2015

(54) MUSICAL INSTRUMENT PICKUP WITH FIELD MODIFIER

(71) Applicant: George J. Dixon, Socorro, NM (US)

(72) Inventor: George J. Dixon, Socorro, NM (US)

( * ) Notice: Subject to any disclaimer, the term of this patent is extended or adjusted under 35 U.S.C. 154(b) by 0 days.

(21) Appl. No.: 13/829,544

(22) Filed: Mar. 14, 2013

(51) Int. Cl.
*G10H 3/18* (2006.01)

(52) U.S. Cl.
USPC ..... 84/726; 84/725; 84/723

(58) Field of Classification Search
USPC ..... 84/723–728
See application file for complete search history.

(56) References Cited

U.S. PATENT DOCUMENTS

| | | | | | |
|---|---|---|---|---|---|
| 2,225,299 | A | | 12/1940 | Demuth | |
| 2,235,983 | A | | 3/1941 | Demuth | |
| 2,573,254 | A | | 10/1951 | Fender | |
| 2,612,072 | A | | 9/1952 | De Armond | |
| 2,612,541 | A | | 9/1952 | De Armond | |
| 2,683,388 | A | | 7/1954 | Keller | |
| 2,817,261 | A | | 12/1957 | Fender | |
| 2,976,755 | A | | 1/1959 | Fender | |
| 2,892,371 | A | | 6/1959 | Butts | |
| 2,896,491 | A | | 7/1959 | Lover | |
| 2,909,092 | A | | 10/1959 | De Armond | |
| 2,911,871 | A | | 11/1959 | Schultz | |
| 2,933,967 | A | | 4/1960 | Ruscol | |
| 3,236,930 | A | | 2/1966 | Fender | |
| 3,249,677 | A | | 5/1966 | Burns et al. | |
| 3,541,219 | A | | 11/1970 | Abair | |
| 3,571,483 | A | | 3/1971 | Davidson | |
| 3,588,311 | A | * | 6/1971 | Zoller | 84/725 |
| 3,916,751 | A | | 11/1975 | Stich | |
| 3,983,777 | A | | 10/1976 | Bartolini | |
| 3,983,778 | A | | 10/1976 | Bartolini | |
| 4,010,334 | A | | 3/1977 | Demeter | |
| 4,184,398 | A | | 1/1980 | Siegelman | |
| 4,220,069 | A | * | 9/1980 | Fender | 84/726 |
| 4,283,982 | A | | 8/1981 | Armstrong | |
| 4,320,681 | A | | 3/1982 | Altilio | |
| 4,364,295 | A | | 12/1982 | Stich | |
| 4,499,809 | A | | 2/1985 | Clevinger | |
| 4,501,185 | A | | 2/1985 | Blucher | |
| 4,524,667 | A | | 6/1985 | Duncan | |
| 4,580,481 | A | | 4/1986 | Schaller et al. | |
| 4,581,974 | A | * | 4/1986 | Fender | 84/725 |
| 4,581,975 | A | * | 4/1986 | Fender | 84/725 |
| 4,624,172 | A | * | 11/1986 | McDougall | 84/726 |
| 4,686,881 | A | | 8/1987 | Fender | |
| 4,907,483 | A | | 3/1990 | Rose et al. | |
| 4,941,388 | A | | 7/1990 | Hoover et al. | |
| 5,123,324 | A | | 6/1992 | Rose et al. | |
| 5,168,117 | A | | 12/1992 | Anderson | |
| 5,221,805 | A | * | 6/1993 | Lace | 84/726 |

(Continued)

OTHER PUBLICATIONS

Hunter, Duncan et al., "The Guitar Pickup Handbook, The Start of Your Sound"(*Backbeat/Hall* Leonard, New York, 2008) (total of 260 pages).

(Continued)

*Primary Examiner* — David S. Warren
(74) *Attorney, Agent, or Firm* — Leydig, Voit & Mayer, Ltd.

(57) ABSTRACT

A magnetic pickup for a stringed musical instrument with a secondary magnetic source that modifies the primary magnetic field distribution of the pickup. The secondary source comprises at least one permanent magnet and may further comprise a ferromagnetic loss component. A method for retrofitting and changing the tone of a pickup by attaching one or more secondary magnetic sources to the pickup.

23 Claims, 14 Drawing Sheets

(56) References Cited

U.S. PATENT DOCUMENTS

| | | | | |
|---|---|---|---|---|
| 5,233,123 | A | 8/1993 | Rose et al. | |
| 5,290,968 | A | 3/1994 | Mirigliano et al. | |
| 5,292,998 | A * | 3/1994 | Knapp | 84/726 |
| 5,292,999 | A | 3/1994 | Tumura | |
| 5,336,845 | A | 8/1994 | Lace, Sr. | |
| 5,354,949 | A | 10/1994 | Zwaan | |
| 5,376,754 | A * | 12/1994 | Stich | 84/728 |
| 5,378,850 | A | 1/1995 | Tumura | |
| 5,389,731 | A * | 2/1995 | Lace | 84/726 |
| 5,391,831 | A | 2/1995 | Lace | |
| 5,399,802 | A * | 3/1995 | Blucher | 84/726 |
| 5,408,043 | A | 4/1995 | Lace | |
| 5,418,327 | A | 5/1995 | Lace et al. | |
| 5,422,432 | A * | 6/1995 | Lace | 84/726 |
| 5,430,246 | A | 7/1995 | Lace et al. | |
| 5,438,158 | A * | 8/1995 | Riboloff | 84/727 |
| 5,530,199 | A | 6/1996 | Blucher | |
| 5,610,357 | A | 3/1997 | Frank-Braun | |
| 5,668,520 | A | 9/1997 | Kinman | |
| 5,792,973 | A * | 8/1998 | Riboloff | 84/726 |
| 5,811,710 | A | 9/1998 | Blucher et al. | |
| 5,834,999 | A | 11/1998 | Kinman | |
| 5,894,101 | A * | 4/1999 | Damm | 84/728 |
| 5,908,998 | A * | 6/1999 | Blucher et al. | 84/728 |
| 5,932,827 | A | 8/1999 | Osborne et al. | |
| 5,949,014 | A | 9/1999 | Rashak et al. | |
| 6,103,966 | A | 8/2000 | Kinman | |
| 6,111,185 | A | 8/2000 | Lace | |
| 6,291,758 | B1 | 9/2001 | Turner | |
| 6,291,759 | B1 | 9/2001 | Turner | |
| 6,392,137 | B1 | 5/2002 | Isvan | |
| 6,846,981 | B2 * | 1/2005 | Devers | 84/728 |
| 6,998,529 | B2 | 2/2006 | Wnorowski | |
| 7,022,909 | B2 * | 4/2006 | Kinman | 84/726 |
| 7,166,793 | B2 | 1/2007 | Beller | |
| 7,189,916 | B2 * | 3/2007 | Kinman | 84/726 |
| 7,227,076 | B2 * | 6/2007 | Stich | 84/726 |
| 7,285,714 | B2 | 10/2007 | Juszkiewicz et al. | |
| 7,288,713 | B2 | 10/2007 | Krozack et al. | |
| 7,399,918 | B2 | 7/2008 | Juszkiewicz et al. | |
| 7,427,710 | B2 | 9/2008 | Hara | |
| 7,595,444 | B2 | 9/2009 | Stewart | |
| 7,718,886 | B1 | 5/2010 | Lace | |
| 7,989,690 | B1 | 8/2011 | Lawing | |
| 7,994,413 | B2 | 8/2011 | Salo | |
| 8,178,774 | B2 | 5/2012 | Salehi | |
| 8,344,236 | B2 * | 1/2013 | Mayes | 84/726 |
| 8,415,551 | B1 * | 4/2013 | Dixon | 84/726 |
| 8,471,137 | B2 | 6/2013 | Adair et al. | |
| 2001/0027716 | A1 | 10/2001 | Turner | |
| 2002/0020281 | A1 * | 2/2002 | Devers | 84/728 |
| 2002/0069749 | A1 | 6/2002 | Hoover et al. | |
| 2002/0083819 | A1 * | 7/2002 | Kinman | 84/726 |
| 2002/0092413 | A1 | 7/2002 | Turner | |
| 2003/0051596 | A1 | 3/2003 | Gustafsson | |
| 2003/0196538 | A1 | 10/2003 | Katchanov et al. | |
| 2004/0003709 | A1 | 1/2004 | Kinman | |
| 2004/0139837 | A1 | 7/2004 | Oskorep | |
| 2005/0092159 | A1 | 5/2005 | Oskorep | |
| 2005/0126376 | A1 * | 6/2005 | Hosler | 84/726 |
| 2006/0112816 | A1 * | 6/2006 | Kinman | 84/728 |
| 2006/0150806 | A1 | 7/2006 | Hara | |
| 2006/0156911 | A1 * | 7/2006 | Stich | 84/726 |
| 2006/0174753 | A1 | 8/2006 | Aisenbrey | |
| 2006/0254405 | A1 | 11/2006 | Bergman | |
| 2006/0275631 | A1 | 12/2006 | Rosenberg | |
| 2007/0017355 | A1 * | 1/2007 | Lace | 84/728 |
| 2007/0056435 | A1 | 3/2007 | Juszkiewicz et al. | |
| 2008/0245218 | A1 * | 10/2008 | Stewart | 84/727 |
| 2009/0320670 | A1 | 12/2009 | Flum et al. | |
| 2010/0005954 | A1 | 1/2010 | Higashidate et al. | |
| 2010/0101399 | A1 | 4/2010 | Calvet | |
| 2010/0122623 | A1 * | 5/2010 | Salo | 84/726 |
| 2011/0100200 | A1 * | 5/2011 | Mayes | 84/726 |
| 2012/0103170 | A1 * | 5/2012 | Kinman | 84/726 |
| 2012/0118129 | A1 * | 5/2012 | Jang | 84/726 |
| 2012/0210847 | A1 | 8/2012 | Adair et al. | |
| 2012/0210848 | A1 | 8/2012 | Yamanaka | |
| 2013/0239788 | A1 * | 9/2013 | Mills et al. | 84/726 |
| 2013/0312591 | A1 * | 11/2013 | Mills | 84/726 |

OTHER PUBLICATIONS

Milan, Mario, "Pickups, Windings and Magnets and the Guitar Became Electric", (*Centerstream*, Anaheim Hills, 2007) (total of 216 pages).

French, Richard M., "Engineering the Guitar, Theory and Practice", (*Spinger*, New York, 2009) (total of 274 pages).

Bozorth, Richard M., "*Ferromagnetism*", (IEEE Press/Wiley, Hoboken, 2003) (Part 1—244 pages).

Bozorth, Richard M., "*Ferromagnetism*", (IEEE Press/Wiley, Hoboken, 2003) Second Part of AP (Part 2—248 pages).

Bozorth, Richard M., "*Ferromagnetism*", (IEEE Press/Wiley, Hoboken, 2003) (Part 3—246 pages).

Bozorth, Richard M., "*Ferromagnetism*", (IEEE Press/Wiley, Hoboken, 2003) (Part 4—244 pages).

Campbell, Peter, "Permanent Magnetic Materials and their Application" (*Cambridge University Press*, Cambridge, 1994) (total 218 pages).

Goldman, Alex. Modern Ferrite Technology, *2nd Edition*, (Springer, New York, 2006), Part 1 (total pp. 218).

Goldman, Alex. Modern Ferrite Technology, *2nd Edition*, (Springer, New York, 2006), Second Part of AS (total pp. 218).

Errede, Professor Steven, Presentation entitled "Electronic Transducers for Musical Instruments", *Department of Physics*, The University of Illinois at Urban-Campaign, AES Talk, UIUC, Nov. 29, 2005 (43 pages).

Lemme, Helmuth E.W., "*The Secrets of Electric Guitar Pickups*", updated Feb. 25, 2009, retrieved from http://buildyourguitar.com/resources/leme/ on May 10, 2009 (9 pages).

Sulzer, Mike, "*Music Electronics Forum*", retrieved from http://music-electronic-forum.com/t13930/ on Sep. 23, 2009 (9 pages total).

Article entitled *Common Magnetic Terminology as Used in Specification and Claims* of U.S. Appl. No. 12/940,478 retrieved from Wikipedia at http://en.eikipedia.org/wiki.

Article entitled "*Seymour Duncan ZephyrTM The Next Great Sound of Guitar*", retrieved from http://www.seymourduncan.com/newproducts/zephyr-silver-pickups.php on Oct. 29, 2011 (15 pages total).

Ressler, Phil, "*Zephyr Silver Background*", retrieved from http://www.seymourduncan.com/forum/showthread.php?t=207793 on May 16, 2012 (15 pages).

Constantinides, Steve, "Semi-Hard Magnets, The important role of material with intermediate coercively", presented at the *Magnetics 2011 Conference*, San Antonio, TX, Mar. 1-2, 2011 (27 pages total).

Lawrence, Bill, "*How Would an Aluminum Bridge Plate Compare with other TeleBridge Plates*?" retrieved from http:www.billawrence.com/Page/ForteleLovers.htm on Dec. 2, 2011 (2 pages).

Lawrence, Bill, "*Bridge Pickup Base Plates*", retrieved from http:www.tdpri.com/resourceBASEPLATE.htm on Dec. 6, 2011 (2 pages).

Lemme, Helmuth, "Electric Guitar Sound Secrets and Technology", *Elektor International Media BV* 2012, ISBN 978-907920-13-4, (Part 1—70 pages).

Lemme, Helmuth, "Electric Guitar Sound Secrets and Technology", *Elektor International Media BV* 2012, ISBN 978-907920-13-4, (Part 2—69 pages).

Lemme, Helmuth, "Electric Guitar Sound Secrets and Technology", *Elektor International Media BV* 2012, ISBN 978-907920-13-4, (Part 3—66 pages).

Lemme, Helmuth, "Electric Guitar Sound Secrets and Technology", *Elektor International Media BV* 2012, ISBN 978-907920-13-4, (Part 4—74 pages).

Article entitled "*Beefing Up Single Coils, This month we will try some new tone tailoring tricks", PremierGuitar*, retrieved from http://www.premierguitar.com/Magzine/Issue/2007.Aug.Befing_Up_Single_Coil.asp x on Nov. 23, 2012 (3 pages).

(56) References Cited

OTHER PUBLICATIONS

Article retrieved from http://www/seymourduncan.com.products/bass/pbas/passive/110441_pickup.on Dec. 17, 2012 *Antiguity for P-Bass®*: (twin coil)11044-11-SeymourDuncan Passive (2 pages total).
DiMarzio, "Ultra JazzTM Pari DP149" retrieved from http://www.dimarzio.com/pickups/bass/standard-bass/ultra-jazz.pair on Nov. 29, 2012 (2 pages total).
Constantinides, Steve, Presentation entitled "Designing with Thin Gauge", *SMMA Fall Technical Conference*, Oct. 2008, (55 pages).
Strnat, Karl J., "Modern Permanent Magnets for Applications in Electro-Technology", *Proc. IEEE*, vol. 78, pp. 923 (1990).
Constantinides, Steve, Presentation entitled "Undercover Magnets", *Iowa State University*—MRS, Apr. 7, 2011 (44 pages).
Cullity, B.D., et al., "Introduction to Magnetic Materials", *IEEE Press/Wiley*, Hoboken 2008, (Part 1—145 pages).
Cullity, B.D., et al., "Introduction to Magnetic Materials", *IEEE Press/Wiley*, Hoboken 2008, (Part 2—140 pages).
Cullity,. B.D., et al., "Introduction to Magnetic Materials", *IEEE Press/Wiley*, Hoboken 2008, (Part 3—132 pages).
Cullity, B.D., et al., "Introduction to Magnetic Materials", *IEEE Press/Wiley*, Hoboken 2008, (Part 4—(132 pages).
Lemarquand, G., et al., "Calculation Method of Permanent-Magnet Pickups for Electric Guitars", IEEE Transactions on Magnetics, vol. 43., No. 9, (Sep. 2007, pp. 3573-3578) (Received in email from Jeff on May 13, 2013).
Horton, Nicholas G., et al., "Modeling the Magnetic Pickup of an Electric Guitar", American Journal of Physics, vol. 77., No. 2, (Feb. 2009, pp. 144-150) (Received in email from Jeff on May 13, 2013).
File History of Related U.S. Appl. No. 12/940,517, filed Nov. 5, 2010 (Now Abandoned).

* cited by examiner

MUSICAL INSTRUMENT PICKUP WITH FIELD MODIFIER

FIELD OF THE INVENTION

The present invention relates to pickups for sensing vibrations in a stringed musical instrument and, more specifically, to musical instrument pickups incorporating secondary magnetic sources that shape the magnetic field distribution and tone of the pickups.

BACKGROUND OF THE INVENTION

String motion sensors, commonly known as pickups, are installed on guitars, bass guitars, mandolins and other stringed musical instruments to convert the sound produced by the vibrating strings to an electronic signal. In various applications, the electronic signal generated by a pickup may be modified using analog and digital signal processing techniques, amplified, and recorded on a suitable sound recording medium before being converted back to a sound signal by a speaker or other output transducer. Conventional musical instrument pickups use different physical principles, including variations in magnetic reluctance, the Hall effect, and the piezoelectric effect, to detect the motion of ferromagnetic strings.

Magnetic reluctance pickups typically comprise one or more ferromagnetic pole pieces, a magnetic source and a coil with output terminals that surrounds the pole pieces. When the pickup is positioned near the ferromagnetic strings of a musical instrument the magnetic source, pole pieces and strings may be modeled as a magnetic circuit with a magnetic flux in each of the elements. The magnetic flux in a pole piece is partially dependent on the distance between the string-sensing surface of the pole piece and a string. String vibrations change the pole-to-string distance and the pole piece flux. The coil surrounding the pole pieces is said to link the flux in the pole pieces and an electromotive force is developed in the coil when the magnetic flux changes. An electronic signal is developed at the output terminals of the coil in response to the electromotive force.

The frequency-dependent response function of a magnetic musical pickup is nonlinear and the input string-motion signal is distorted by the pickup in the process of converting it to an electronic signal. This distortion imparts certain tonal attributes to the string-sensing process and, when properly controlled, adds desirable and highly musical qualities to the output signal.

Magnetic reluctance pickups came into common usage during the 1950's when hard ferromagnetic material and sensor technologies evolved to a point that the pickups could be economically mounted on a musical instrument. Magnetic pickups have been developed for many different instruments and a significant commercial market exists for magnetic guitar pickups. For purposes of clarity, the features of the present invention will be discussed with reference to a 6-string guitar with ferromagnetic strings. It will, however, be obvious to those skilled in the art that the scope of the invention is not limited to 6-string guitars and magnetic pickups that embody features of the invention may be mounted on many different instruments. Other instruments that are commonly equipped with magnetic pickups include, but are not limited to, 12-string guitars, bass guitars, mandolins, and steel guitars.

Magnetic musical instrument pickups may be classified into broad categories that reflect differences in basic design and tonal quality. Pickups in the 'single coil' category have key design features that are shared by the pickups disclosed in U.S. Pat. No. 2,612,072 issued to H. de Armond on Sep. 30, 1952, U.S. Pat. No. 2,573,254, No. 2,817,261, No. 3,236,930, and No. 4,220,069 respectively issued to Leo Fender on Oct. 30, 1951, Dec. 24, 1957, Feb. 22, 1966, and Sep. 2, 1980 and U.S. Pat. No. 2,911,871 issued to C. F. Schultz on Nov. 10, 1959. The 'single coil' name derives from the fact that pickups in this category comprise a set of string-sensing ferromagnetic pole pieces with a magnetic flux that is linked by a single, string-sensing coil of wire. Some single coil pickups have pole pieces that are formed from magnetized hard ferromagnetic materials that generate the flux in the pickup. In other single coil designs a separate permanent magnet induces magnetic fields in the pole pieces. Single coil pickups have no means for external noise rejection and are sensitive to external electromagnetic noise sources.

The external noise sensitivity of a magnetic pickup may be significantly reduced by adding a second wire coil to the pickup. The second coil is designed to generate an electronic output signal at its terminals with a noise component that is similar to the noise output of the first coil. Noise reduction is accomplished by connecting the two coils so that the noise signals have opposite phases.

Noise-reducing humbucking pickups or 'humbuckers' share key design features with the devices that are disclosed in U.S. Pat. No. 2,896,491 issued to Seth Lover in Jul. 28, 1959 and U.S. Pat. No. 2,892,371 issued to J. R. Butts on Jun. 30, 1959. Pickups in this class have at least two-string sensing coils, each linking a magnetic flux in a separate set of string-sensing pole pieces. The magnetic field direction in the poles and the direction of signal propagation within the coils are selected so that a large portion of the string-generated signals from the two coils have an in-phase, additive relationship and a large percentage of the common-mode noise signals from the two coils have an out-of-phase, subtractive relationship. Split-blade designs such as the Lindy Fralin Split-blade pickups manufactured by Lindy Fralin of Richmond, Va. also fall into the 'humbucking' category. In most cases, the output signal amplitude of a humbucking pickup is greater than that obtained from a single coil pickup and the output noise signal is smaller.

Noise-cancelling single coil pickups have tonal characteristics similar to those of single coil pickups and comprise a single set of string-sensing poles, a string-sensing coil and a noise-cancelling coil that is connected to the string-sensing coil. In some designs, the noise-cancelling coil links the flux in a set of passive pole pieces. Illustrative noise-cancelling single coil pickups are disclosed in U.S. Pat. No. 7,166,793 issued to Kevin Beller on Jan. 23, 2007, U.S. Pat. No. 7,189,916 issued to Christopher I. Kinman on Mar. 13, 2007, and U.S. Pat. No. 7,227,076 issued to Willi L. Stich on Jun. 5, 2007.

Active circuitry is incorporated into some magnetic pickups to decrease the output impedance of the pickup, increase the output amplitude and, in some cases, modify the pickup tone. Active pickups with different coil and pole piece designs are manufactured, for example, by EMG, Inc. of Santa Rosa, Calif.

The design and manufacture of magnetic musical instrument pickups are described from an historical and lay engineering perspective in *The Guitar Pickup Handbook, the Start of Your Sound* by Duncan Hunter (Backbeat/Hal Leonard, New York, 2008), *Pickups, Windings and Magnets and the Guitar Became Electric* by Mario Milan (Centerstream, Anaheim Hills, 2007) and *Electric Guitar, Sound Secrets and Technology* by Helmuth Lemme (Elektor, Netherlands, 2012). On a more technical level, *Engineering the Guitar, Theory and Practice* by Richard Mark French (Springer, New York, 2009) contains a chapter on Guitar Electronics and a thorough treatment of musical sound quality and tone as viewed from an engineering and physics perspective.

BRIEF SUMMARY OF THE INVENTION

The tone of a magnetic musical instrument pickup is partially determined by the magnetic field distribution that is induced in the strings of an instrument by the pickup. In conventional designs, the magnetic field is generated by a primary magnetic source and, in some cases, it may be shaped by soft ferromagnetic components. In pickups embodying the invention the magnetic field distribution that is generated by the primary magnetic source is shaped by a weaker secondary magnetic source. The secondary source is typically located near the strings when the pickup is mounted in the instrument and is a comparatively simple and inexpensive tool for altering the primary magnetic field distribution. In its various embodiments, the invention allows the pickup designer to create new magnetic field distributions and thereby extend the range of tones that can be generated using magnetic pickup technology. Because of their comparative simplicity, secondary sources may also be added to existing pickups by a musician or luthier to alter the pickup's tone. Some pickups that embody the invention have at least one ferromagnetic pole piece that is surrounded by a wire coil. A mounting structure holds the pole piece and coil in stable relative positions and facilitates mounting the pickup in a musical instrument with ferromagnetic strings. When the pickup is mounted in an instrument, a primary magnetic source in the pickup creates a primary field distribution in the pickup pole pieces and one or more of the instrument strings. The primary field distribution is modified by a weaker, secondary magnetic source that is separate from the pole pieces and the primary magnetic source.

The maximum induction of the secondary source may be less than half of the maximum induction of the primary source and, in embodiments with magnetized hard ferromagnetic pole pieces, the pole pieces may be the primary magnetic source. In embodiments with soft ferromagnetic pole pieces, the primary magnetic source may comprise one or more permanent magnets that are mounted on the side of the coil that is furthest removed from the strings.

The secondary magnetic source may advantageously include one or more permanent magnets that are formed from low-cost bonded or flexible hard ferromagnetic materials that can be easily shaped and attached to the pickup. Other suitable secondary source materials include, but are not limited to, sintered Alnico and rare earth permanent magnet materials, magnetically hard ferrite materials, and machinable permanent magnets.

Secondary magnetic sources may have fields that are oriented in various directions with respect to the magnetic fields in the pickup pole pieces including parallel, antiparallel and orthogonal directions. Secondary sources may also comprise two or more magnets that are oriented in the same or different directions. Sonic pickups include pickup covers and, in certain embodiments of the invention, the secondary source may be mounted on or embedded in a pickup cover.

In addition to the tonal changes that result from the modifications of the primary magnetic field distribution of a pickup by a secondary magnetic source, the tone of a pickup may be additionally affected by ferromagnetic losses in the secondary source. In further embodiments of the invention the secondary source includes one or more composite secondary magnets that comprise a permanent magnet component and a ferromagnetic loss component. The permanent magnet component may advantageously be a bonded or flexible permanent and the loss component may be formed from a material that comprises a granular ferromagnetic material and an insulating binder, a hysteresis material, a soft ferromagnetic material, or a nonferromagnetic conductor.

The invention is further embodied in a method for altering the tone of a magnetic pickup by attaching a secondary magnetic source to an existing pickup. The secondary source comprises at least one secondary permanent magnet that is bonded to a surface of the pickup with a conventional adhesive, painted or coated on the surface, or mounted in a holder that is removably fastened to the pickup. In pickups with covers, the secondary source may be attached to a pickup cover and, in pickups with removable covers, the original cover may be replaced by a cover that that includes the secondary source.

Secondary sources that are attached to an existing pickup according to the inventive method may have composite structures with loss elements that are formed from materials that comprise granulated ferromagnetic materials and an insulating binder, hysteresis materials, soft ferromagnetic materials, and nonferromagnetic conductors. They may also include two or more permanent magnets or have self-adhesive surfaces that facilitate the modification of an existing pickup by a musician or other end user.

DESCRIPTION OF THE EMBODIMENTS

Magnetic pickups that embody the invention share a set of basic operating principles that may be incorporated into a wide range of different pickup designs. For purposes of clarity, features of the present invention will be illustrated using a small number of representative architectures with the knowledge that they can be appropriately incorporated into other pickups by those with skill in the art of pickup design.

Figure 1:
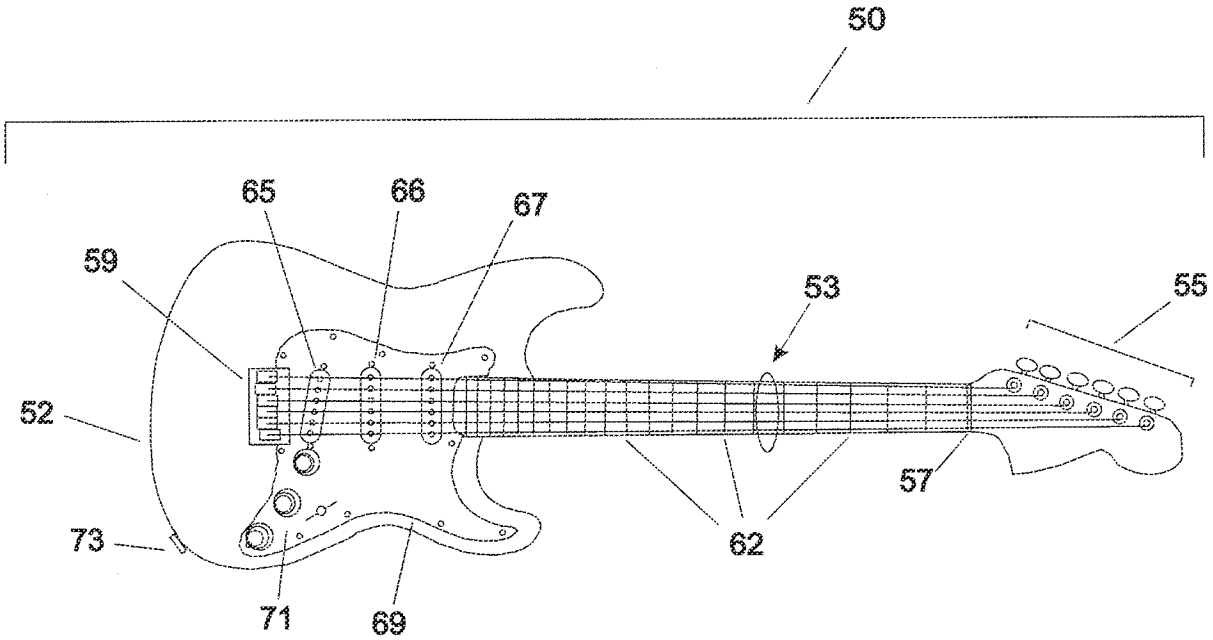
FIG. 1 is a front view of a Stratocaster-style guitar with six ferromagnetic strings and three Stratocaster-style single coil magnetic pickups.

FIG. 1 illustrates a solid-body Stratocaster-style guitar 50 with a set of six ferromagnetic strings 53. The fundamental vibrational frequency of each string is determined by the string diameter, the string tension and the length of the vibrating portion. As illustrated in FIG. 1, the length of the vibrating portion is equal to the distance between the nut 57 and the bridge 59 and the tension of each string is adjusted by one of a set of six machine heads 55. A musician shortens the vibrational length of a string by pressing the string against a fret, such as one of the frets 62. Three magnetic pickups 65, 66, 67, that are typically single coil pickups on a Stratocaster-style guitar, are mounted on a pickguard 69 that is attached to the guitar body 52 with screws. Each of the magnetic pickups 65, 66, 67 generates an electronic output signal in response to the string vibrations and the pickup output signals are routed to an electronic control circuit 71. The control circuit typically comprises capacitors and variable resistors that allow a musician to vary the amplitude and frequency spectrum of the instrument output and a switch that connects one or more of the pickups 65, 66, 67 to the output jack 73.

The amplitude and tonal features of the electronic output signal from a pickup that is mounted in a musical instrument are determined by the radius and composition of the strings, the detailed design features of the pickup, and the spacing between the pickup and the strings. Typically, the fidelity with which the output signal of a magnetic pickup represents the spectrum of the vibrating strings is not high and it is a common practice to describe distortions by attributing a 'musical tone' or a 'tonal quality' to the pickup.

The terms 'musical tone,' and 'tonal quality' are commonly used by those skilled in the art of musical instrument and pickup design to refer to a set of physical parameters that determine the musical qualities of the sound emanating from an instrument or component as perceived by a human observer. In this patent application, the terms 'pickup tone,' 'tonal quality,' and 'sound quality' will be used interchangeably to describe the contributions of the pickup to the perceptual features of a sound generation process. This process typically includes the conversion of the sound produced by the vibrating strings of the instrument to an electronic signal that is routed through one or more signal processing and amplification stages before being converted to sound by a speaker. Because it senses string motion and generates the electronic signal that is amplified and modified by downstream components, the sound quality of a pickup plays a significant role in determining the overall tone of an amplified instrument. Sound qualities that are lost in the process of string vibration sensing are also lost to subsequent stages of the signal processing and amplification process.

According to R. M French in the chapter of *Engineering the Guitar, Theory and Practice* entitled "Sound Quality" (pp 180-207, Springer, New York, 2009), "few topics are more controversial than sound quality. Skilled players and experienced listeners generally agree on subjective rankings of instruments, but the differences are notoriously difficult to measure and to describe using objective metrics." Like flavor, artistic quality, and other variables that describe the properties of an item in terms of its effect on human perception, good sound quality and tone are readily recognized by a knowledgeable individual but impossible to completely quantify using physical measurement parameters.

Figure 2:
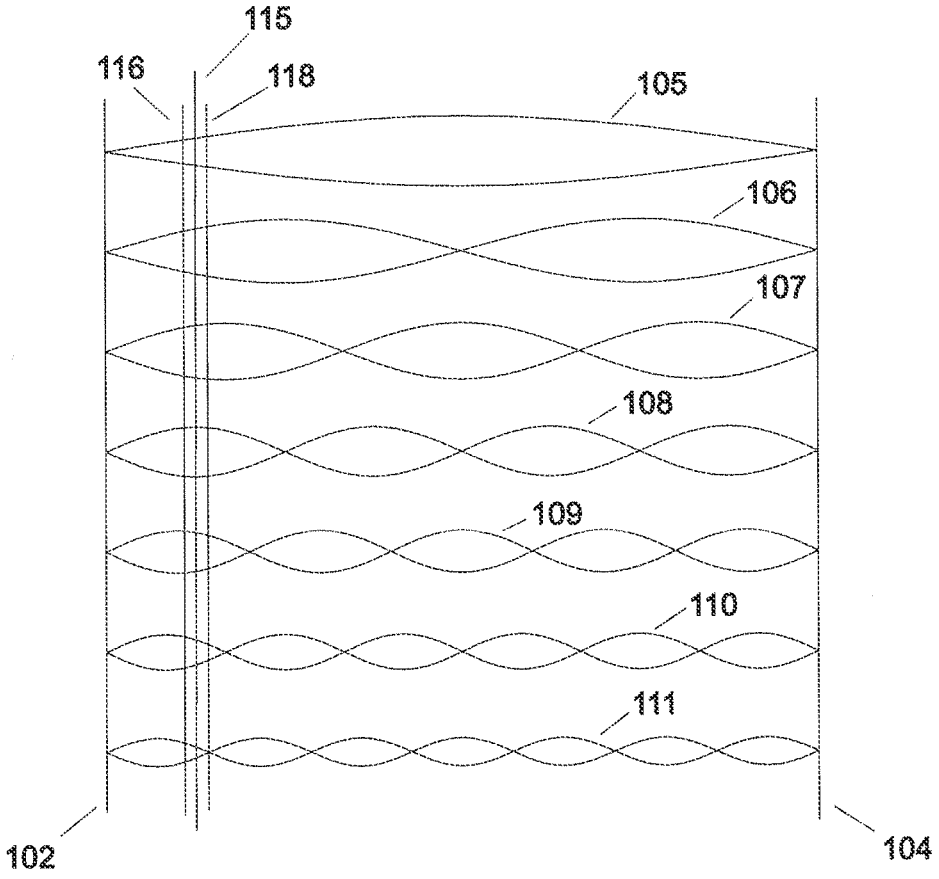
FIG. 2 is a schematic representation of the standing wave harmonic modes in a ferromagnetic musical instrument string.

Magnetic instrument pickups generate an output signal when the magnetic flux in one or more string-sensing ferromagnetic pole pieces changes in response to the motion of an instrument string. The motion of an instrument string may be approximated by a combination of standing waves with integrally related frequencies. FIG. 2 illustrates the fundamental standing wave pattern 105 and the first six higher order harmonic wave patterns 106-111 of a string that is constrained at the end positions 102, 104. In the guitar 50 that is illustrated in FIG. 1, the position 102 is the location where the string contacts the bridge 59 and the position 104 is the location where the string contacts the nut 57 or one of the frets.

When a string is plucked or strummed, it vibrates in a combination of the standing wave vibrational modes 105-110 and, in some cases, additional higher order modes. The vibration of the string at the position 115 can be described by a mathematical series of sinusoidally-varying terms with frequencies and coefficients that are determined by the frequencies and relative amplitudes of the vibrational modes. Magnetic pickups induce a magnetic field in the string and sample its vibrational motion over a magnetic window. The magnetic window of a pickup with pole pieces at the position 115 is represented by the region between the line 116 and the line 118 in the illustration of FIG. 2. When a pickup is mounted in a guitar, the magnetic window is a two dimensional shape that is principally determined by the magnetic field distribution of the pickup.

The pole pieces in a pickup may be formed from ferromagnetic materials that are commonly classified as 'hard' or 'soft' to reflect the ease with which magnetic domains in the material can be realigned by an external magnetic field. At least one coil surrounds the pole pieces and string-induced changes in the magnetic field that is linked by the coil generate an electrical signal in the coil. The ends of the coil are connected to a set of output terminals that allow the pickup to be connected to the control circuit of an instrument.

An accurate model of the physical phenomena that affect magnetic pickup tone necessarily includes the effect of ferromagnetic component material properties. While the terms used to describe these properties are well-understood by those who work with ferromagnetic materials, they are less familiar to those in the magnetic pickup community and their definitions will be briefly reviewed to facilitate a more complete understanding of the invention. Rigorous treatments of ferromagnetic material properties and the formalism that is used to describe them are found in *Ferromagnetism* by Richard M. Bozorth (IEEE Press/Wiley, Hoboken, 2003) and *Introduction to Magnetic Materials* by B. D. Cullity and C. D. Graham (IEEE Press/Wiley, Hoboken, 2008).

When a DC current passes through a long solenoidal coil with an air core, a magnetic field is generated in a direction that is parallel to the axis of the coil. The strength of the magnetic field, H, in Oersteds, is related to the current flowing through the coil, i, in amperes, by:

$$H=i(4\pi/10)(n/L),$$

where (n/L) is the number of turns per centimeter of solenoid length in the axial direction. When a core material is inserted in the solenoid, the magnetic induction within the material, B, in Gauss is related to the magnetic field, H, by the following expression:

$$B=\mu H=H+4\pi M$$

where μ is the permeability of the core material and M is magnetization of the material. The magnetization, M, reflects the contribution of magnetic domains within the material to the induction, B. Its value is dependent on the orientation of the domains (the magnetic history of the material) and on the magnitude and frequency of the magnetic field, H. In ferromagnetic materials, the permeability saturates at a value near unity at high field strengths and may be defined as the derivative of the induction, B, with respect to the field strength, H at a given value of H.

A ferromagnetic material is said to be 'hard' if it takes an appreciable magnetic field to change the domain alignment and 'soft' if the required field is comparatively small. The stability of the magnetization in 'hard' materials makes them generally useful as permanent magnets while the 'soft' materials are commonly used as pole materials in motors and other magnetic devices and as core materials in inductors, transformers, and solenoidal antennas. The saturating field intensity is significantly larger for hard materials and the permeability significantly smaller at lower applied magnetic fields.

Hysteresis curves are two-dimension graphs of the magnetic induction, B, in a ferromagnetic material as a function of an applied magnetic field, H. Curves with different shapes are generated under different applied field conditions. The major hysteresis curve describes the magnetization in a material when the applied field is slowly cycled between large positive and negative values and the initial magnetization curve describes the transition between a zero field state in which the magnetic domains are unoriented and a saturated state in which all of the domains are aligned in the field direction.

Figure 3:
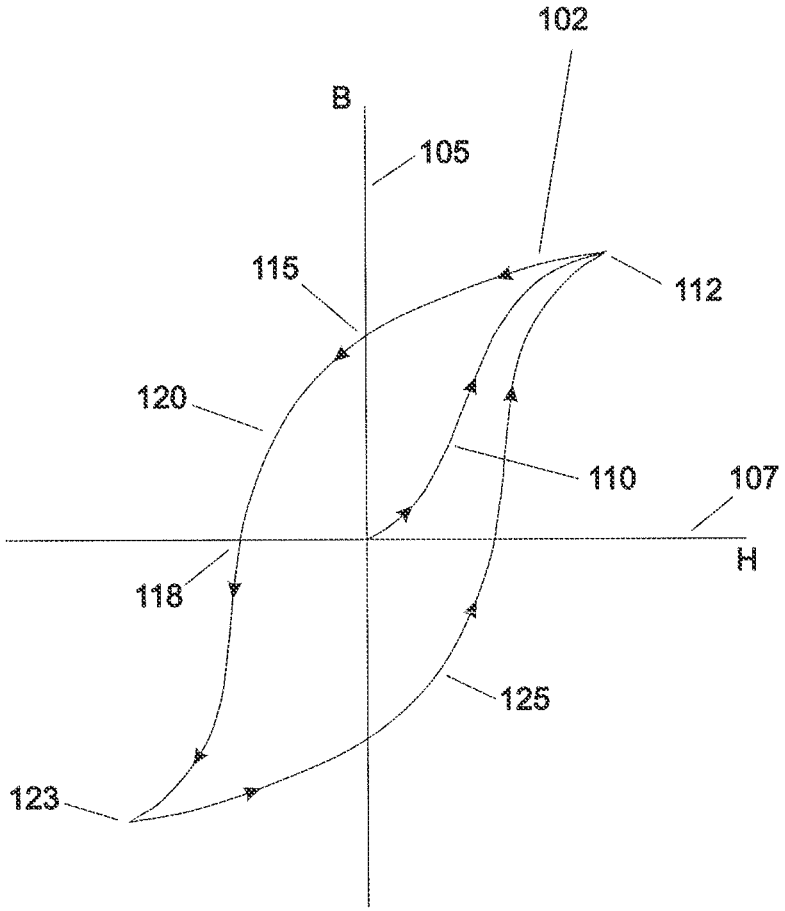
FIG. 3 is a two dimensional graph of a representative major hysteresis curve.

FIG. 3 illustrates a graph of the initial magnetization curve and major hysteresis curve for a representative ferromagnetic material. In this graph, the value of the magnetic induction in the material, B, is represented along the vertical axis 105 and the value of the applied magnetic field, H, is represented along the horizontal axis 107. If the material is initially unmagnetized and the applied field, H, is equal to zero, the magnetic induction, B, is also zero and state of the material is represented by a point at the origin. As the applied magnetic field is increased, the magnetic induction increases along the initial magnetization curve 110 until the magnetization in the material saturates at the point 112. While the slope of the hysteresis curve at applied fields above saturation is approximately unity, the unequal scales of the axes 105, 107 make the slope of the representative curve 102 appear smaller than unity at the saturation point 112.

If the value of H is increased beyond the saturation point 112 then decreased, the induction, B, decreases along the curve 120. The portion of the curve 120 in the second quadrant of the graph where H is negative and B takes on positive values, describes the variation of induction with applied field for a material that has been previously magnetized and, for this reason, is known as the 'demagnetization curve' for the material. Demagnetization curves for hard ferromagnetic materials are useful in the design of electromagnetic machinery and are often published by manufacturers of permanent magnet materials.

The magnetization of the previously-saturated material gives rise to a non-zero induction 115 when the strength of the applied field is equal to zero and the value of this induction is commonly referred to as the "remanence" of the material. This parameter is one of the fundamental properties used to describe permanent magnetic materials.

As the magnetic field, H, takes on increasingly negative values, the magnetic induction, B, also decreases along the curve 120 and is equal to zero at the H-axis intercept, 118. The value of the magnetic field, H, at point 118 is known as the 'normal coercive force' or 'coercivity' of the material and is commonly represented by the symbol, H. Its value is another metric that is commonly used to specify ferromagnetic materials.

As the applied field, H is decreased beyond the point 118, the magnetic induction takes on increasingly negative values and eventually saturates at the point 123. When the field is decreased beyond this point and subsequently increased, the induction, B, follows the curve 125 and eventually saturates in the positive direction at the point 112.

Figure 4:
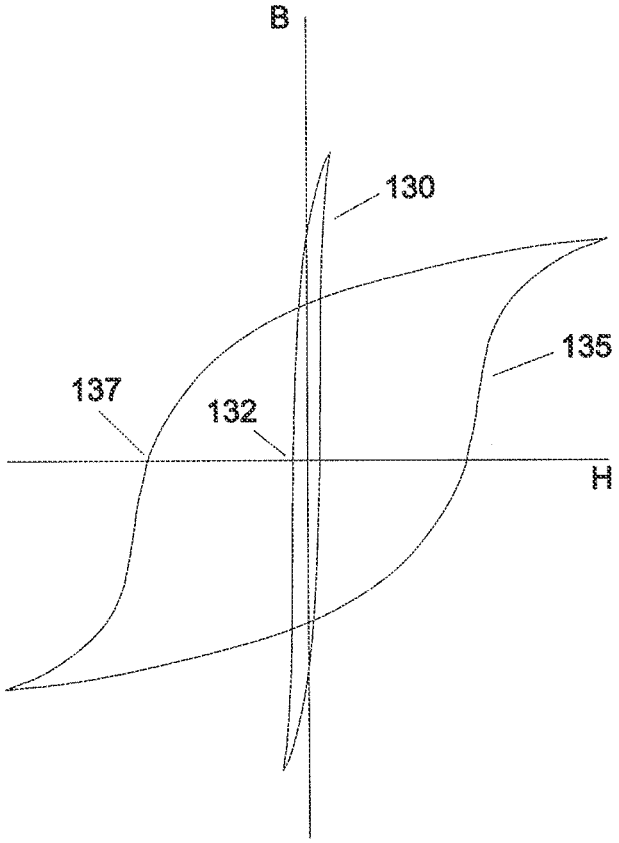
FIG. 4 is a two dimensional graph illustrating the qualitative differences in the shapes of the major hysteresis curves of hard and soft ferromagnetic materials.

The area enclosed by a hysteresis curve is a measure of the work that must be performed by the applied field as the magnetization of a material is cycled around the curve. Changing the direction of the magnetization in hard ferromagnetic materials is more difficult than in soft ferromagnetic materials and this difference is reflected in the comparatively large coercivity values and major hysteresis loop areas of the hard materials. FIG. 4 is a graph illustrating the qualitative differences in the shapes of the hysteresis curves for representative hard and soft ferromagnetic materials. The curve 130 is a representative hysteresis curve of a soft material and has a comparatively small area and coercivity, 132. The curve 135 is a representative hysteresis curve of a hard material and has a significantly larger area and coercivity, 137.

Soft ferromagnetic materials have comparatively large values of permeability and are commonly used as core materials in transformers and chokes, magnetic pole pieces, electromagnetic shields and in other applications that require the concentration of magnetic flux. Soft ferromagnetic materials typically have small normal coercivity values that reflect the responsiveness of their magnetization direction to an external magnetic field. The normal coercivity value is typically used to distinguish hard and soft materials and, in the present application, soft ferromagnetic materials are defined as having normal coercivity values that are less than 100 Oersteds (Oe). Ferromagnetic properties that are typically specified for soft ferromagnetic materials include the initial permeability for unmagnetized material in the presence of small, slowly varying magnetic fields and the field intensity at which the magnetization saturates. The variation of permeability with the strength and frequency of an external field may also be specified in addition to frequency-dependent toss coefficients.

Figure 5:
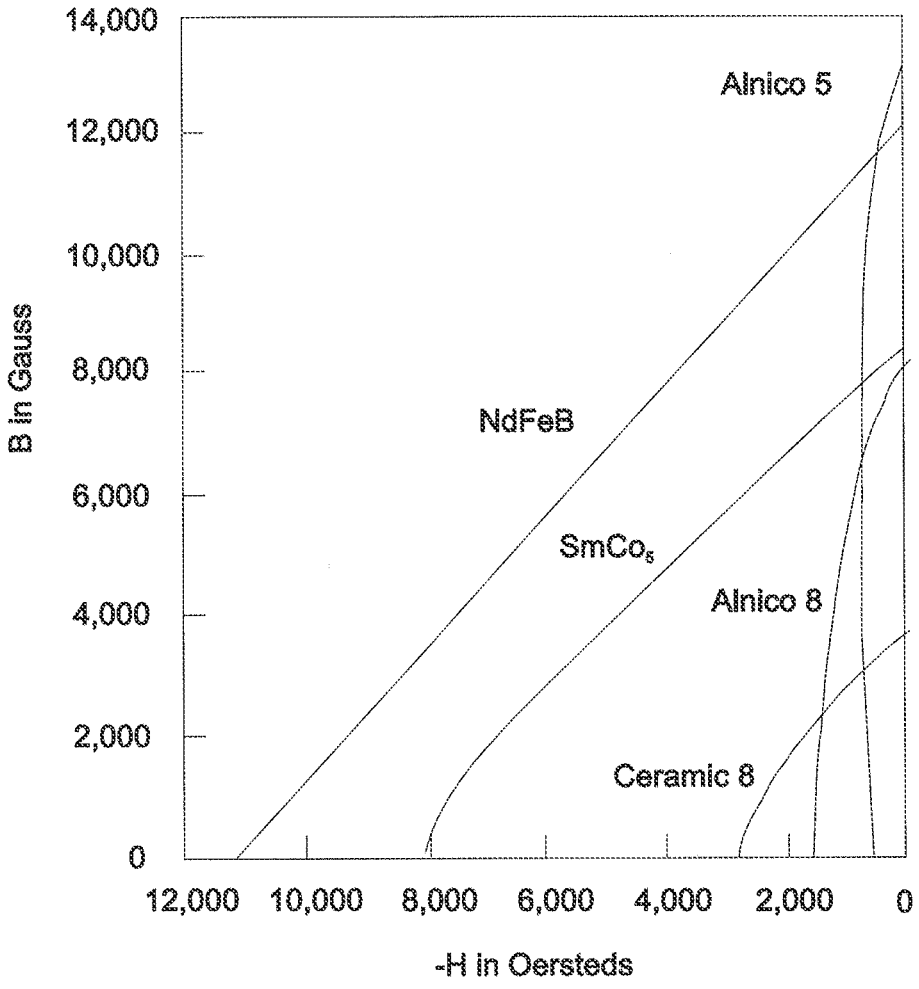
FIG. 5 is a two dimensional graph illustrating the demagnetization curves for representative materials in several hard ferromagnetic material classes.

Ferromagnetic materials with coercivities greater than or equal to 100 Oe are defined in this application as hard ferromagnetic materials. The subset of hard ferromagnetic materials with normal coercivities in the range of 100 Oe to 1000 Oe are also referred to as hysteresis materials. Hard ferromagnetic materials are typically used to make permanent magnets and hysteresis loss elements. Important ferromagnetic properties for these materials include remanence, coercivity, and conductivity in addition to the shape of the demagnetization curve and the maximum value for the product of induction and magnetic field. FIG. 5 is a two dimensional graph, adapted from "Modern Permanent Magnets for Applications in Electro-Technology," by Karl J Strnat, *Proc. IEEE*, Vol. 78, pp. 923 (1990), that illustrates the demagnetization curves for representative hard ferromagnetic materials. Of the illustrated materials, Alnico 5 is the only material with a coercivity that falls within the hysteresis material range.

While the ferromagnetic properties that can be extracted from major hysteresis curves and initial magnetization curves of the type illustrated in FIG. 3 are useful for many applications, additional parameters are needed to describe the behavior of ferromagnetic materials that are subjected to small variations in the applied field. In a magnetic pickup, for example, the pole pieces are typically maintained at a fixed magnetic bias and the vibrating strings produce small, audio frequency perturbations in the bias field. Under these conditions, the induction in the material deviates from the slowly-varying major hysteresis curves illustrated in FIGS. 3 and 4 and are more accurately described by minor or recoil hysteresis loops. Minor hysteresis loops are typically observed for hard and soft ferromagnetic materials that are subjected to small perturbations of steady-state magnetic fields in all quadrants of the major hysteresis loop graph.

Figure 6:
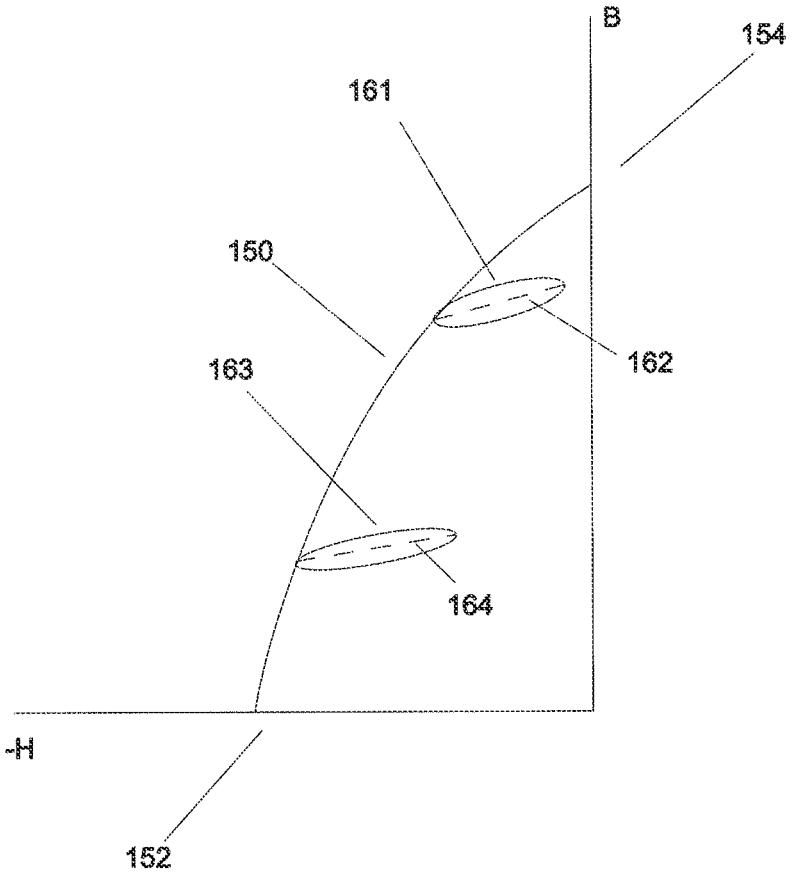
FIG. 6 is a two dimensional graph illustrating the demagnetization curve and representative recoil hysteresis loops for a hard ferromagnetic material.

FIG. 6 illustrates the demagnetization curve 150 and a set of minor or recoil hysteresis loops 161, 163 for a hard ferromagnetic material such as Alnico 3 that has been initially magnetized to saturation by the applied field. The coercivity, $H_c$, of the illustrated material is equal to value of the applied field at the H-axis intercept 152 of the demagnetization curve 150 and the remanence, $B_r$, is equal to the value of the induction at the B-axis intercept, 154. The recoil hysteresis loops 161, 163 describe the behavior of the material when the applied field is fixed at different bias values and cycled over a small range. The slopes of the major axes 162,164 of the recoil hysteresis loops 161,163 are equal to the recoil permeability values for the material at the corresponding bias field strength. The energy required to cycle the magnetization around a recoil loop is known as the recoil hysteresis loss and is proportional to the recoil loop area. In most materials, the recoil hysteresis loss increases with the magnitude of the biasing field.

In a typical magnetic pickup, the ferromagnetic components are subjected to DC bias fields and small, audio frequency fields with frequencies and magnitudes that are determined by the string vibrations. In a typical Stratocaster-style single coil pickup with full-magnetized Alnico 5 pole pieces, for example, the magnetic induction at the pole ends has a bias value of approximately 1000 Gauss and the vibration of the ferromagnetic strings generate audio frequency perturbations in the bias field and the induction in the material that are described by recoil hysteresis loops. The energy expended in moving around the loops represents a loss to the system and the nonlinearity of the recoil process adds harmonics to the audio frequency spectrum of the string-induced field perturbations.

Time-varying magnetic fields in conductive ferromagnetic materials also generate eddy currents that result in additional frequency-dependent losses. Eddy current losses are approximately proportional to the square of the perturbing field frequency and increase with the conductivity and maximum dimension of a component in a plane that is approximately perpendicular to the time-varying magnetic field.

The size and shape of the magnetic window over which a pickup samples the string vibrations when it is mounted in a guitar or other stringed instrument partially determine the harmonic spectrum of the pickup output signal. In conventional pickups with magnetized pole pieces, the shape of the magnetic window is conventionally determined by the pole pieces and by any ferromagnetic components that may be coupled to them and, in pickups with soft ferromagnetic pole pieces, the window is further determined by permanent magnets that are coupled to the pole pieces. In this application, magnetized hard ferromagnetic pole pieces and permanent magnets that contribute significantly to the flux in the pole pieces are cumulatively referred to as the primary magnetic source of the pickup. The primary magnetic field distribution of a pickup is generated by the primary source and any soft ferromagnetic components that are coupled to it.

In pickups that embody the present invention, the primary magnetic field distribution is modified by a secondary magnetic source that comprises one or more secondary permanent magnets. The fields generated by the secondary magnets are weaker than the fields generated by the primary magnets and maximum field strength of the secondary source is typically less than 50% of the primary field strength. The secondary magnets are physically separated from the pickup pole pieces and are typically positioned in the half of the pickup that is nearest the strings. In a typical embodiment, the secondary magnetic source modifies the magnetic field distribution in the strings but has little effect on the magnitude of the magnetic field in the pole pieces. Magnetic windows with shapes and dimensions that are impossible to obtain with primary sources can be easily obtained using secondary sources.

Secondary magnets may be advantageously formed from ceramic and rare earth flexible magnet materials and may also affect the tone of a pickup through ferromagnetic loss mechanisms. When a pickup embodying the invention is mounted in an instrument, the pickup and strings form a magnetic circuit that includes the secondary source. Losses, including eddy current, minor loop and recoil hysteresis, in the circuit components affect the pickup tone to a degree that increases with the magnitude of the losses. The losses of many secondary magnets are small but can be significantly increased through the incorporation of one or more ferromagnetic loss elements. Composite magnets that comprise a magnetized hard ferromagnetic component and a ferromagnetic loss element, for example, are comparable in size and strength to low loss monolithic magnets and may be incorporated in certain embodiments of the invention to shape the tone.

Monolithic and composite secondary magnetic sources are typically small, lightweight and inexpensive. They are easily bonded to one or more surfaces of a magnetic pickup during initial manufacture and may, in certain cases, be incorporated into bobbins, endplates, or other structures. Secondary sources may also be attached to existing pickups with an adhesive in order to modify their tone. Suitable adhesives may be permanent or repositionable, and, in certain cases, one or more of the surfaces on a secondary source may be coated with a peel-and-stick adhesive so that a musician or other end user can easily attach the source to a pickup.

Figure 7:
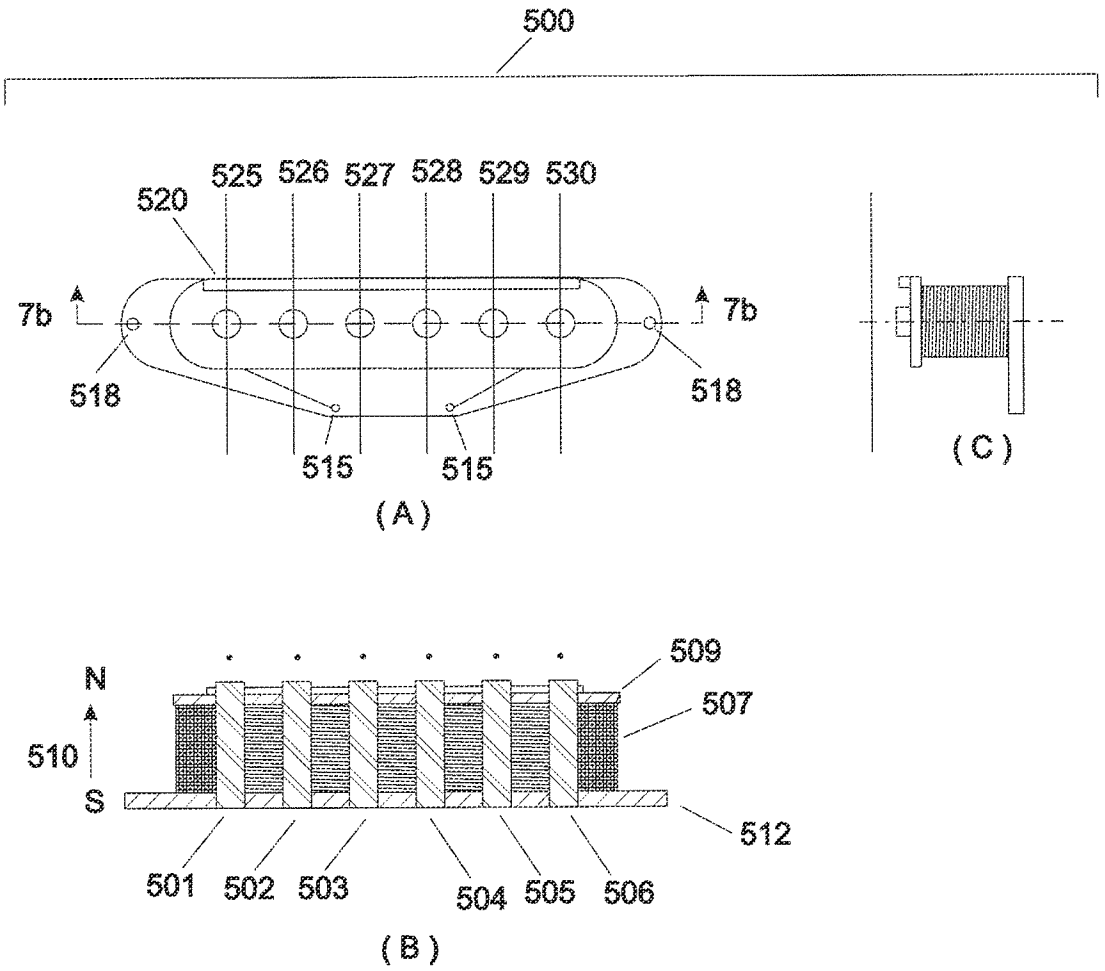
FIG. 7(A) is a top projection view of a single coil pickup with a secondary magnet that embodies features of the invention.
FIG. 7(B) is a sectional front view of the inventive single coil pickup taken along the line 7*b* in FIG. 7(A).
FIG. 7(C) is a side projection view of the inventive single coil pickup.

FIG. 7(A)-(C) illustrates a Stratocaster-style single coil pickup 500 that embodies features of the invention. Pickups of this design are commonly installed in guitars with the design features of the guitar 50 that is illustrated in FIG. 1. The pickup 500 comprises six self-magnetized pole pieces 501-506 that are formed from fully-magnetized Alnico 5. The diameters of the pole pieces are typically between 0.187"-0.250" and the pole piece lengths commonly range from 0.625" to 0.780". The lengths of the pole pieces in the pickup 500 are approximately equal but, in alternative designs, they may be staggered. When fully magnetized, Alnico 5 pole pieces with these dimensions have magnetic inductions that are typically greater than or equal to 1000 Gauss at their poles. The magnetic field within the pole pieces is oriented in the direction 510 with North poles on the upper, string-sensing pole piece faces.

The pole pieces 501-506 are pressed into holes in an upper end plate 509 and a lower end plate 512 to form a mechanically-stable assembly. The endplates are formed from vulcanized fiberboard (Forbon an alternative insulating structural material. The wire coil 507 is wound directly on the pole pieces 501-506 and laterally constrained by the end plates 509, 512. In a typical design, the coil 507 has approximately 8000 turns of number No. 42 wire that is insulated with one or more layers of a conventional insulating material such as Formvar, plain enamel or polyurethane. The ends of the wire coil 507 are typically soldered to conductive eyelets 515 that facilitate connecting the pickup to the control circuit of a guitar and threaded holes 518 in the bottom end plate 512 allow the pickup to be secured to a guitar in a conventional fashion. The pickup 500 is typically mounted under a set of ferromagnetic strings 525-530 in an instrument such as the guitar 50 that is illustrated in FIG. 1. In a typical installation, the pole pieces 50'-505 of the pickup 500 are positioned in approximate alignment with the strings 525-530.

The primary magnetic field in the pickup 500 is generated by the pole pieces 501-505 and the primary field distribution is modified by a secondary magnetic source 520 that is magnetized with the approximate direction and polarity of the arrow 510. In a representational embodiment, the secondary magnetic source 520 is formed from standard energy Ultramag material manufactured by the Flexmag Division of Arnold Magnetics in Marietta, Ohio. It is attached to the upper endplate 509 with a conventional adhesive such as contact cement, cyanoacrylate cement or epoxy and is approximately 0.030" thick in the direction of the arrow 510, is 2.375" long in the direction of the section plane **7*b*-7*b*, and 0.090" wide. The flux densities at the poles of the secondary magnetic source 520 are typically in the range of 100 Gauss-200 Gauss and are significantly less than flux densities at the surfaces of the primary pole piece magnets 501-506**.

In alternative embodiments, the pole pieces 501-505 may be formed from alternative Alnico alloys or other hard ferromagnetic materials. The secondary magnetic source 520 may also be formed from an alternative hard ferromagnetic material such as a bonded permanent magnetic material, a sintered Alnico alloy, a machinable permanent magnetic material such as an alloy of FeCrCo and CuNiFe, or a hard ferrite magnet. Powdered and granulated permanent magnet materials that are used in the manufacture of flexible and bonded magnets may be incorporated into a number of coating materials and applied to the surface of a pickup with a brush or other applicator. The secondary magnetic source may also have different shapes and dimensions and be magnetized at various angles to the magnetization direction of the pole pieces. In further embodiments of the invention, the secondary magnetic source may be attached to a pickup cover or to a removable holder.

Figure 8:
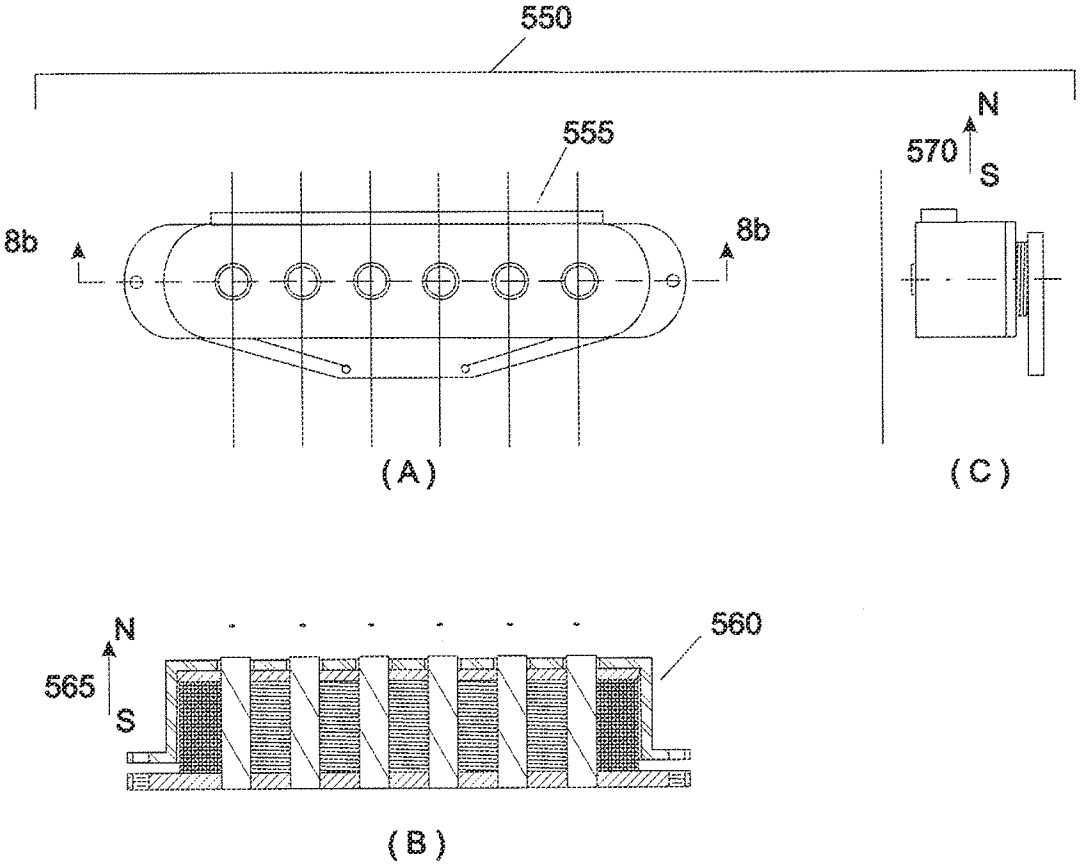
FIG. 8(A) is a top projection view of a single coil pickup with a magnetic pickup cover that embodies the invention.
FIG. 8(B) is a sectional front view of the inventive single coil pickup and magnetic cover taken along the line 8*b* in FIG. 13(A).
FIG. 8(C) is a side projection view of the inventive single coil pickup and cover.

FIG. 8(A)-(C) illustrates a Stratocaster-style single coil embodiment 550 with a secondary permanent magnet 555 that is mounted on a side of the pickup cover 560. With the exception of the pickup cover 560 and secondary magnetic sources 520, 555 the components and function of the pickup 550 are identical to those of the pickup 500 that is illustrated in FIG. 7(A)-(C). The primary magnetic field is generated by the pole pieces which are magnetized with the direction and polarization of the arrow 565. The secondary magnet 555 is magnetized in direction that is orthogonal to the direction of the pole piece magnetization as indicated by the arrow 570.

In a representative embodiment, the magnet 555 is formed from standard energy Ultramag material with a thickness of 0.064" in the direction of magnetization. The width of the secondary magnet in the direction of the pole piece axes is approximately 0.125" and the length in the direction of the section plane **13*b*-13*b* is approximately 2.375," In further embodiments, the magnet 555** may have other dimensions and may be magnetized and/or mounted so that the secondary field is directed at various angles to the magnetization direction of the pole pieces.

Figure 9:
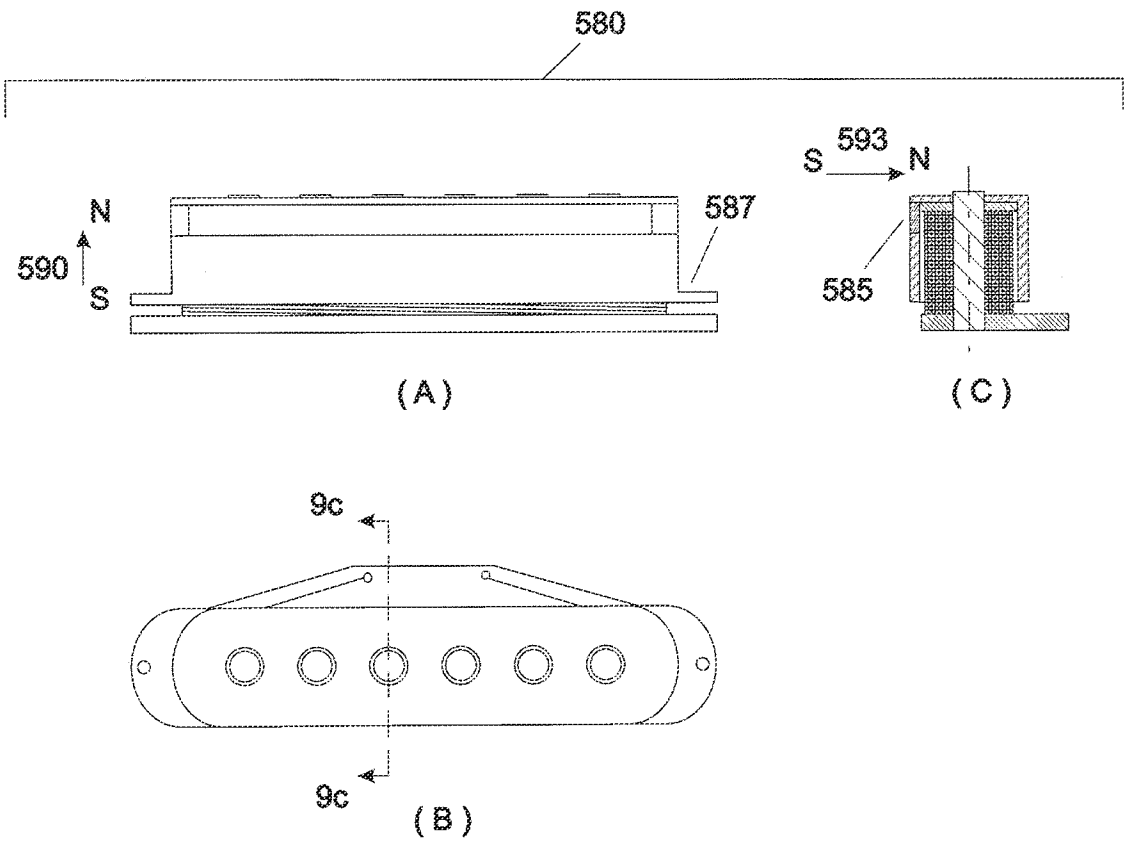
FIG. 9(A) is a front projection view of a single coil pickup and magnetic cover that embodies the invention.
FIG. 9(B) is a top projection view of the inventive single coil pickup and magnetic cover.
FIG. 9(C) is a sectional side view of the inventive single coil pickup and magnetic cover taken along the line 9*c* in FIG. 9(B).

Secondary magnetic sources may also be mounted on an inside surface of a pickup cover or incorporated into a pickup cover. FIG. 9(A) (C) illustrates a Stratocaster-style single coil pickup 580 with a secondary permanent magnet source 585 that is embedded in the side wall of the pickup cover 587. In the illustrated embodiment, the secondary magnet 585 is embedded in the cover 587 with an epoxy or an alternative conventional adhesive. With the exception of the pickup cover 587 and secondary magnetic sources 520, 585, the components and function of the pickup 580 are identical to those of the pickup 500 that is illustrated in FIG. 7(A)-(C). The primary magnetic field is generated by the pole pieces which are magnetized with the direction and polarization of the arrow 590. The secondary magnet 585 is magnetized in a direction that is orthogonal to the direction of the pole piece magnetization as indicated by the arrow 593.

In a representative design, the magnet 585 is formed from standard energy Ultramag material with a thickness of 0.040" in the direction of magnetization. The width of the secondary magnet in the direction of the pole piece axes is approximately 0.125" and the length in the direction orthogonal to the section plane **9*c*-9*c* is approximately 2.25." In further embodiments, the magnet 585 may have other dimensions and may be magnetized and/or mounted so that the secondary field is directed at various angles to the magnetization direction of the pole pieces. The pickup cover may alternatively be completely formed from a bonded magnetic material and, in such cases, the magnet 585** may be defined by patterning the magnetization or the concentration of hard ferromagnetic granules. Secondary sources that are mounted on single coil pickup covers may be easily removed or reconfigured by replacing the pickup cover. This advantageous property of the invention is also inherent in secondary magnets that are attached to a pickup or pickup cover with a a positionable adhesive.

Figure 10:
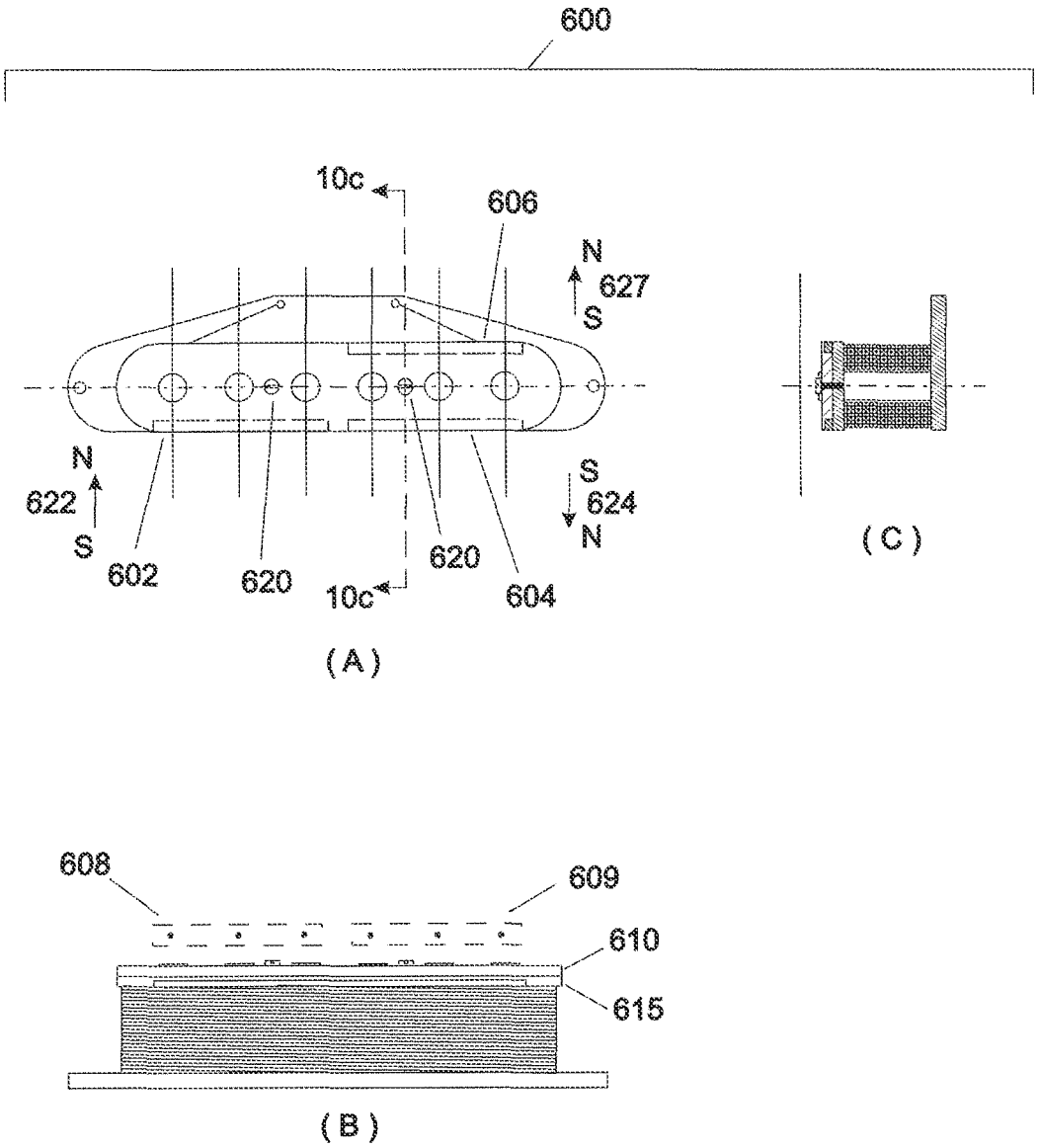
FIG. 10(A) is a top projection view of a single coil pickup with a removable magnetic top plate that embodies features of the invention.
FIG. 10(B) is a front projection view of the inventive single coil pickup and removable magnetic top plate.
FIG. 10(C) is a sectional side view of the inventive single coil pickup and removable magnetic top plate taken along the line 10*c* in FIG. 10(A).

In further embodiments, secondary magnetic sources may comprise two or more permanent magnets with different properties, field strengths or field directions. FIG. 10(A)-(C) is a sectioned orthographic projection drawing of a pickup 600 with three secondary magnets 602, 604, 606 that are positioned to affect two groups of strings 608, 609 in different ways. With the exception of the secondary magnets 520, 602, 604, 606 and the carrier 610, the components of the pickup 600 are similar in type and function to the components of the Stratocaster-style single coil pickup 500 that is illustrated in FIG. 7(A)-(C).

The three magnets 602, 604, 608 are formed from standard energy Ultramag material and have cross sections that are approximately 0.060" square and lengths of approximately 1.125". They are embedded in a removable carrier 610 that is formed from 0.090" thick Forbon or other suitable insulating structural material and attached tote upper endplate 615 of the pickup 600 with two screws 620. The poles of the magnets 604, 606 that affect the three strings 609 with the lowest frequencies are oriented with their North poles directed away from the pole pieces as indicated by the arrows 624, 627. The poles of the magnet 602 that affects the three strings 608 with the highest frequencies are oriented so that the North pole is directed towards the pole pieces as indicated by the arrow 622. In alternative embodiments, the magnets 602, 604, 606 may be formed from alternative hard ferromagnetic materials including machinable materials such as FeCrCo and CuNiFe, sintered alnico, ceramic and rare earth materials, and bound alnico, ceramic and rare earth materials. Two or more of the magnets 602, 604, 606 may also have different dimensions, magnetic field directions, magnetic field strengths and be formed from different materials. While the pickup 600 has three secondary magnets that are mounted on a single surface of the carrier, the number of secondary magnets in alternative embodiments is only limited by the physical size of the magnets and pickup. Secondary magnets may also be affixed or embedded on orthogonal surfaces pickup elements such as endplates, pickup covers and removable carriers or oriented with their magnetic fields in different directions.

When a magnetic pickup is mounted in a guitar or other instrument with ferromagnetic strings, the flux amplitude in the ferromagnetic pickup components varies in response to string vibrations. Ferromagnetic losses in pole pieces, magnetic sources and other pickup components modify the frequency spectrum of the aux variations and, when property controlled, improve the tonal properties of the pickup output signal. In a pickup that embodies the present invention, the amplitude of the magnetic flux in the secondary magnetic source typically varies in response to string vibrations and the tone of the pickup is affected by ferromagnetic losses in the secondary source. The eddy current and hysteresis loss coefficients in standard energy Ultramag and many other bonded hard ferromagnetic materials are comparatively small and, for this reason, the ferromagnetic losses in secondary magnetic sources that are formed from these materials have a minor effect on pickup tone. Components that are formed from sintered and bonded Alnico alloys, machinable hard materials, and Cobalt or other magnetic steels have significantly larger loss coefficients.

The ferromagnetic losses of magnets that are formed from materials with small loss coefficients may be advantageously increased by attaching a material with significantly higher ferromagnetic loss coefficients to the magnet. In further embodiments of the invention, composite secondary magnets that comprise a magnetized hard ferromagnetic component and a ferromagnetic loss component are used to shape the pickup tone. In a typical design, the field generated by the composite magnet is similar in magnitude and direction to the field generated by the permanent magnet component and the loss coefficients are principally determined by the loss component. The composite magnet losses may be engineered over a wide range by varying the number, dimensions, and the composition of the loss elements.

Figure 11:
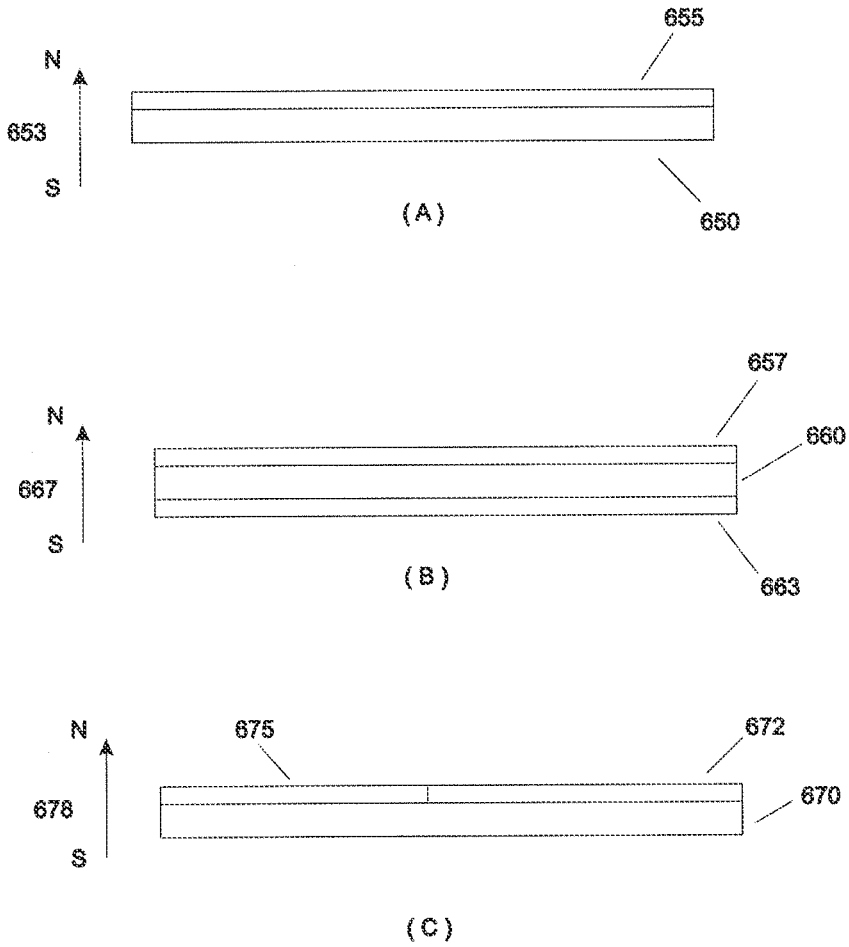
FIG. 11(A) is front projection view of a composite magnet with one permanent magnet component and one ferromagnetic loss component.
FIG. 11(B) is a front projection view of a composite magnet with one permanent magnet and two ferromagnetic loss components that are attached to opposite surfaces of the permanent magnet.
FIG. 11(C) is a front projection view of a composite magnet with one permanent magnet and two ferromagnetic loss components that are attached to different regions of a surface of the permanent magnet.

FIG. 11(A)-(C) are orthographic front projection drawings of representative composite secondary magnet structures. The composite structure illustrated in FIG. 11(A) is a simple stacked structure that comprises a permanent magnet component 650 and a ferromagnetic loss component 655. In a representative example, the dimensions of the two components are approximately equal in planes that are perpendicular to the viewing direction and the components have widths of 0.125" and lengths of 2.375." The permanent magnet component 650 is approximately 0.060" thick and is formed from standard energy Ultramag material. It is magnetized with the polarity and direction of the arrow 653 and has a polar surface field strength that is typically less than 200 Gauss. The loss element 655 is approximately 0.020" thick and is formed from granulated Alnico 3 that is incorporated into a medium acrylic art gel binder in the volume ratio of 3:8. Materials that comprise a granulated hysteresis or soft ferromagnetic material and an insulating binder have useful loss properties that can be engineered over a wide range and are more fully detailed in U.S. patent application Ser. No. 13/827,644 that was filed on Mar. 14, 2013.

In alternative embodiments, the permanent magnet element 650 may be formed from any hard ferromagnetic material with suitable magnetic properties including materials with appreciable hysteresis and eddy current loss coefficients. The loss element may similarly be formed from a wide range of materials including bound granules of hard and soft ferromagnetic materials, soft ferromagnetic materials, machinable hard ferromagnetic materials, and non-ferromagnetic conductors. The dimensions of the composite magnet components may also be varied over a wide range and the top view dimensions of the two components may be different.

FIG. 11(B) illustrates a stacked composite secondary magnet structure that comprises a hard ferromagnetic component 660, and two loss components 657, 663. In a representative embodiment, the hard ferromagnetic component is magnetized with the polarity and direction of the arrow 667 and is formed from Reance F65, a flexible Neodymium material manufactured by the Electrodyne Company of Batavia, Ohio. The upper loss component 657 is formed from iron filings in a high solid acrylic art gel binder and the lower loss element 663 is formed from a low carbon steel such a 1018 alloy steel. The thickness of the permanent magnet component 660 is approximately 0.030" and the thickness of the bound iron filing and 1018 steel components are approximately 0.020" and 0.003" respectively.

FIG. 11(C) illustrates an alternative stacked composite secondary magnet structure that is designed to influence the tone of different groups of strings in different ways. In a representative design, the hard ferromagnetic component 670 is formed from a material that comprises NdB and Alnico 4 granules in a bonding material of the type commonly used to make flexible neodymium magnets. It is magnetized with the polarity and direction of the arrow 678. The loss component 672 covers approximately half of the upper surface of the magnet 670 and is formed from iron filings in a flexible epoxy binder. The other half of the upper magnet surface is covered by the loss component 675 which is formed from Alnico 3 in a flexible polyurethane molding compound. The thickness of the magnet 670 is approximately 0.090" and the loss elements are approximately 0.030" thick.

The secondary magnet designs that are illustrated in FIG. 11(A)-(C) are representative of the large number of composite magnet designs that may be incorporated into embodiments of the invention. In their various configurations, composite magnetic structures enable a pickup designer to vary the field strength and loss properties of secondary magnetic sources over a wide range and, in certain cases, to spatially configure the components to influence the tone of different strings in different ways.

While many features of the invention have been illustrated using Stratocaster single-coil embodiments, those who are skilled in the art of pickup design and manufacturing will realize that secondary magnetic sources may be used to modify the magnetic field distribution of pickups with a wide range of different designs. These pickups include, but are not limited to, P90-style single coil pickups, Gibson-style full-sized humbuckers, Filtertron and other Gretsch-style humbuckers, NY-, Johnny Smith- and Firebird-style mini-humbuckers, P-bass, Jazz, MusicMan (MM), soapbar and humbucking bass pickups, MFD Z-coil pickups, MFD wide single-coil pickups, and MFD humbucker pickups, Lace Sensor pickups, EMG and other active pickups, noiseless single coil pickups and pickups with one or more blade pole pieces.

Figure 12:
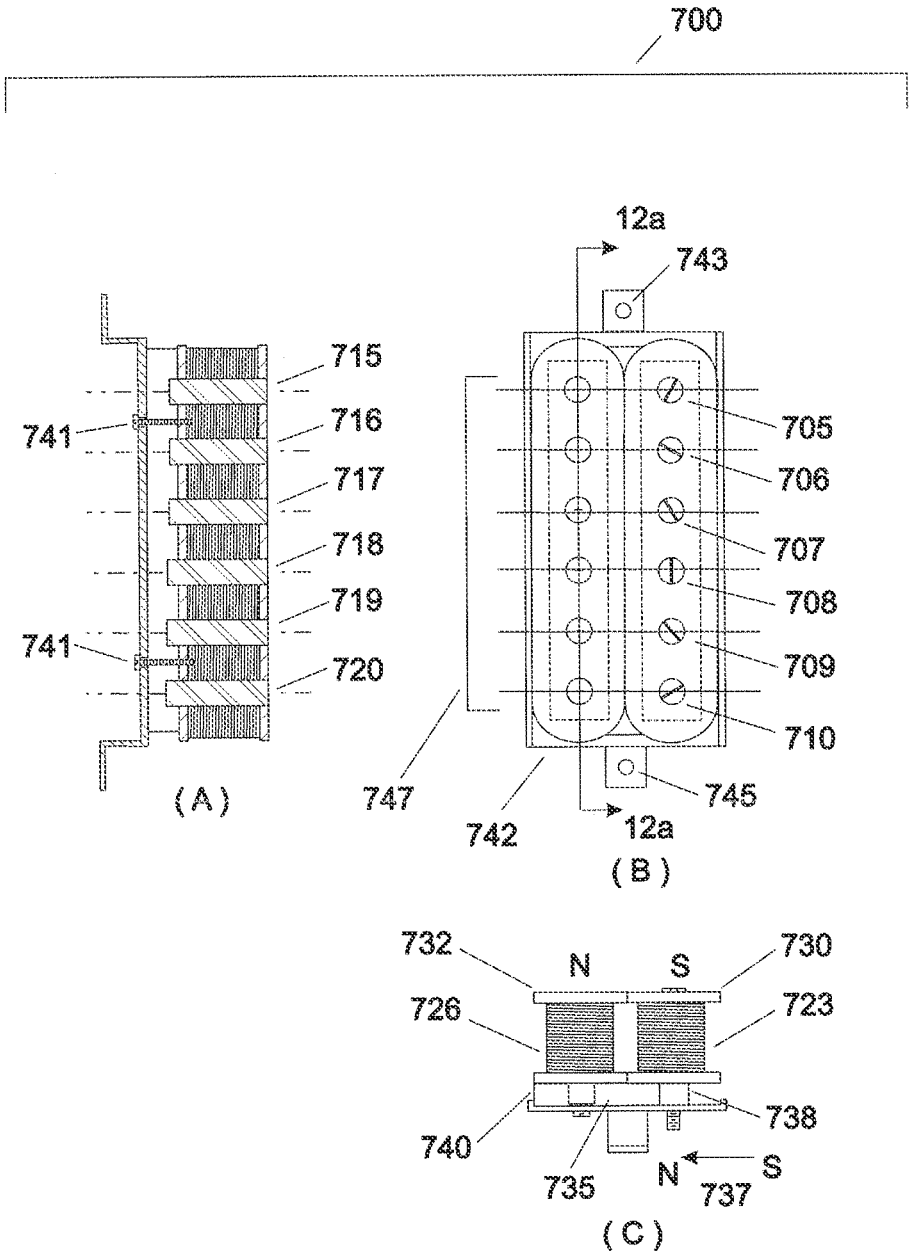
FIG. 12(A) is a sectional side view of a Gibson-style humbucking pickup that embodies the invention with the cover and secondary magnet removed that is taken along the line 12*a* in FIG. 12(B).
FIG. 12(B) is a top projection view of the inventive Gibson-style humbucking pickup without the cover and secondary magnet.
FIG. 12(C) is a front projection view of the inventive Gibson-style humbucking pickup without the cover and secondary magnet.
Figure 13:
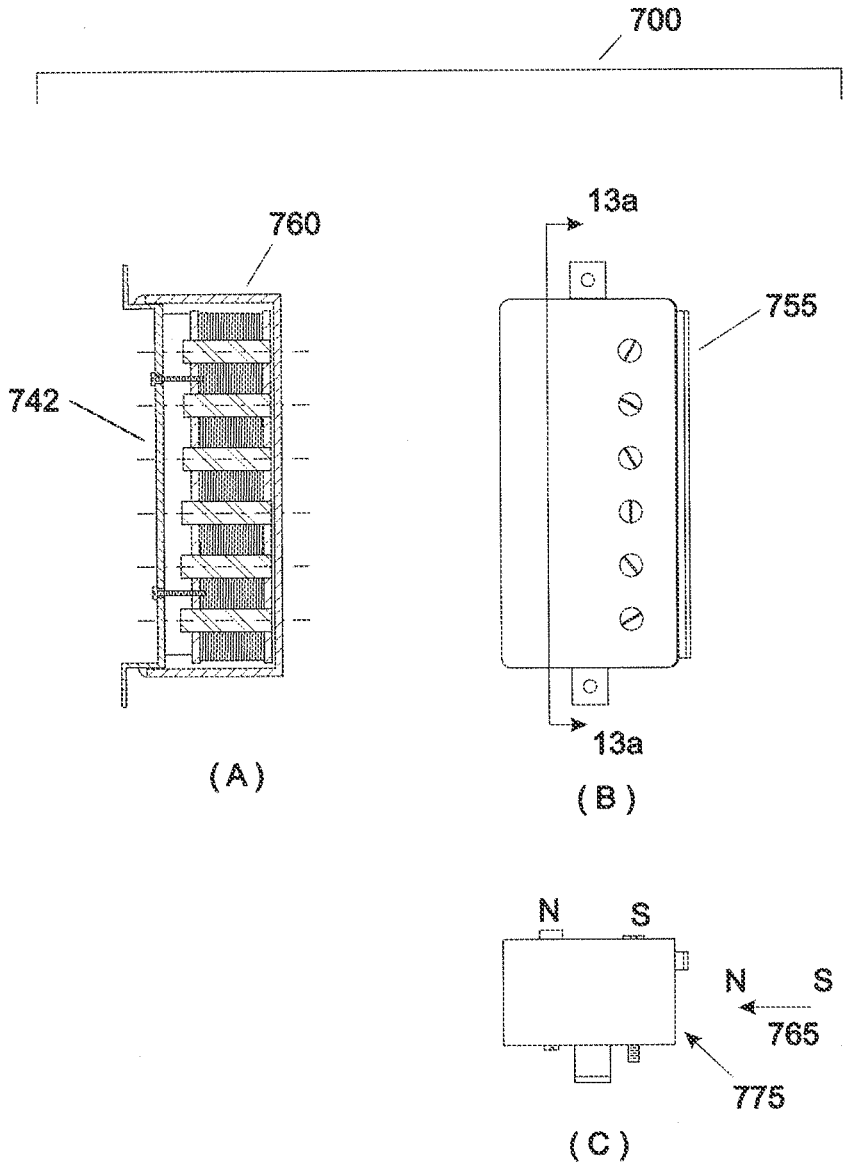
FIG. 13(A) is a sectional side view of the inventive Gibson-style humbucking pickup illustrated in FIG. 13(A)-(C) with pickup cover and secondary magnet taken along the line 13*a* in FIG. 13(B).
FIG. 13(B) is a top projection view of the inventive Gibson-style humbucking pickup illustrated in FIG. 13(A)-(C) with pickup cover and secondary magnet.
FIG. 13(C) is a front projection view of the inventive Gibson-style humbucking pickup illustrated in FIG. 13(A)-(C) with pickup cover and secondary magnet.

FIGS. 12(A)-(C) and FIGS. 13(A)-(C) illustrate a covered Gibson-style humbucker 700 that embodies features of the invention. FIG. 12(A)-(C) illustrates the pickup 700 with the conventional nickel silver cover 760 and secondary magnet 755 removed and the FIG. 13(A)-(C) illustrates the fully assembled pickup.

Without the cover and secondary magnet, the pickup 700 as illustrated in FIG. 12(A)-(C) comprises a set of screw pole pieces 705-710 and a set of slug pole pieces 715-720 that are both formed from high permeability soft ferromagnetic materials such as low carbon steel. In a representative example, the slug poles 715-720 are 0.500" long conventional nickel-plated cylinders with an approximate diameter of 0.187". The screw poles 705-710 have fillister heads and 5-40 threads.

The slug poles 715-720 are supported by an insulating bobbin 732 that may be formed from a butyrate or other suitable plastic material and partially surrounded by a wire coil 726. The screw poles 705-710 are threaded into the insulating bobbin 730 and partially surrounded by the wire coil 723. The wire coils 723, 726 are wound in a similar fashion and are connected so that the string-induced signals from the two coils are approximately in phase. In a representative case, each coil comprises 5250 turns of No. 42 plain enamel wire.

The permanent magnet 735 induces magnetic fields in the slug poles and the screw poles that are antiparallel and directed along the polar axes. In a representative example, the permanent magnet is fabricated from Alnico 4 and is fully magnetized with the direction and polarity of the arrow 737 so that the upper surfaces of the slug poles 715-720 are North poles and the heads of the screw poles 705-710 are South poles. The Alnico 4 magnet 735 is approximately 0.125" thick×0.50" wide×2.50" long and the magnetic induction at a pole of the magnet 735 is approximately 500 Gauss.

The slug poles 715-720 are directly side-coupled to the North pole of the magnet 735 and the screw poles 705-710 are coupled to the South pole by a soft ferromagnetic keeper bar 738. The bobbin 730 is partially supported by the magnet 735 and the keeper bar 738 and the bobbin 732 is partially supported by the magnet 735 and a support bar 740 that is typically formed from maple, delrin, or other insulating structural material. The bobbins, pole pieces, magnet, support bar and keeper bar are held in stable relative positions by screws 741 that pass through the conventional nickel silver base plate 742 and are threaded into the bobbins 730, 732. Threaded holes 743, 745 in the baseplate allow the pickup 700 to be conventionally mounted in a guitar with the pole pieces approximately aligned with respect to the strings 747.

As illustrated in FIG. 13(A)-(C) the pickup cover 760 is soldered to the baseplate 742 of the humbucker 700 and the composite secondary magnet 755 is bonded to the pickup cover 760 with a conventional adhesive. The screw poles and slugs have opposite magnetic polarities as indicated in FIG. 13(C) and the composite secondary magnet 755 is magnetized with the polarity and direction of the arrow 765. The approximate induction of the secondary magnet 755 is less than 200 Gauss and it is mounted with its permanent magnet component nearest the pickup cover.

In a representative example, the permanent magnet component of the composite secondary magnet 755 is formed from standard energy Ultramag material and has a thickness of approximately 0.060" in the direction of the magnetization arrow 765. The magnet surface that is attached to the pickup cover is approximately 0.125" high by 2.50" long. The composite magnet has a loss component with the same surface dimensions as the permanent magnet and a thickness of approximately 0.020". It is formed from iron filings that are incorporated into an epoxy binder in the volume ratio of approximately 3:8.

In alternative Gibson-style humbucker, the secondary magnet 755 may have different structures and additional secondary magnets may be added to surfaces of the pickup that are orthogonal or parallel to the surface 775 of the pickup cover 760. Secondary magnets may also be attached directly to the pickup bobbin and covered by the nickel silver cover 760.

Figure 14:
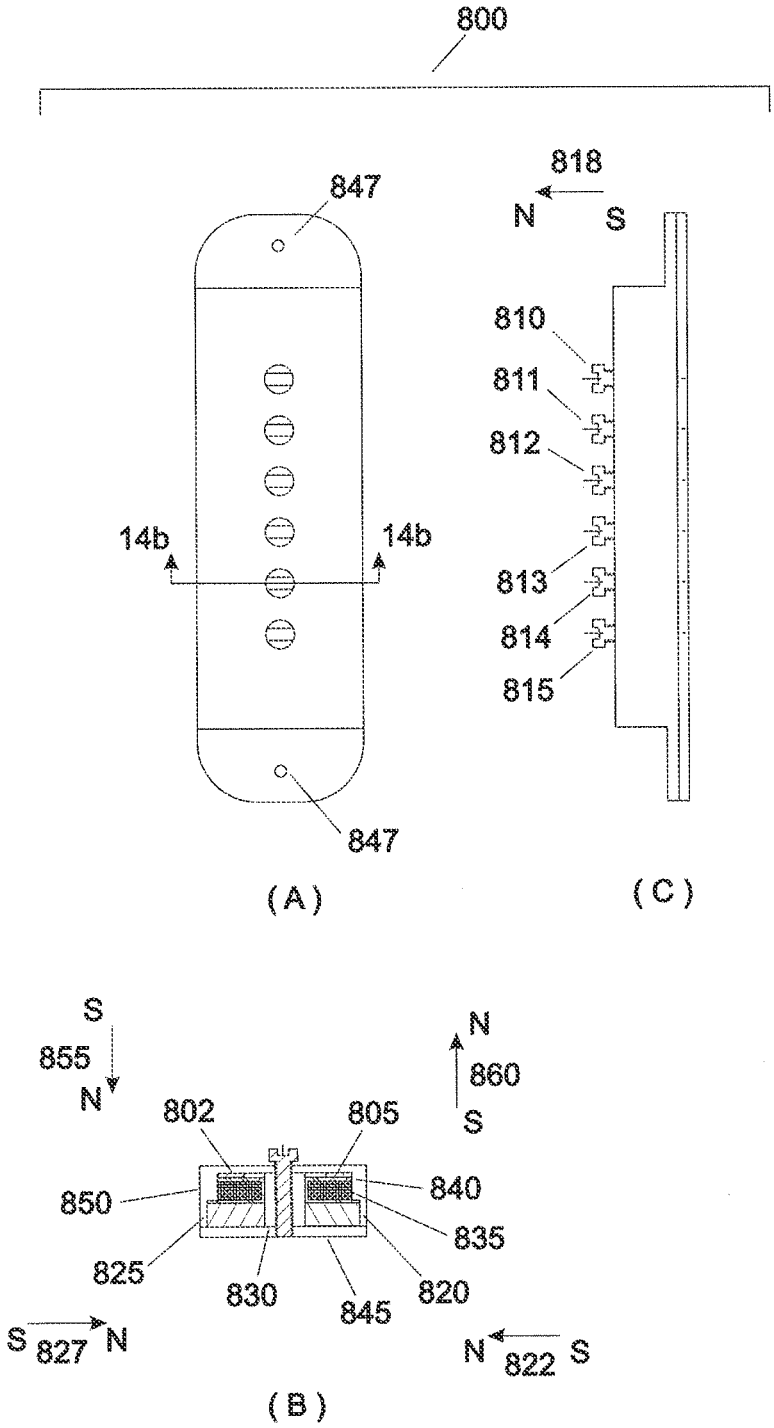
FIG. 14(A) is a top projection view of a P90 style pickup embodying the invention with two secondary magnets that are magnetized in opposing directions.
FIG. 14(B) is a sectional front view of the inventive P90-style pickup taken along the line 14*b* in FIG. 14(A).
FIG. 14(C) is a side projection view of the inventive P90-style pickup.

FIG. 14(A)-(C) is a sectioned orthographic drawing illustrating a P90-style pickup 800 with a secondary magnetic source that comprises two permanent magnets 802, 805. The pickup 800 has six soft ferromagnetic screw poles 810-815 that are magnetized with the polarity and direction of the arrow 818 by permanent magnets 820,825. The magnet 820 is typically formed from an Alnico alloy such as Alnico 2 and magnetized with the direction and polarization of the arrow 822. The magnet 825 is formed from the same alloy and magnetized with the direction and polarization of the arrow 827. The magnets 820,825 are ferromagnetically coupled to the pole pieces 810-815 by a keeper bar 830 that is typically formed from a low carbon steel alloy or other high permeability material. The keeper bar 830 and pole pieces 805-810 are partially surrounded by a coil 835 that is wound on the insulating bobbin 840. The magnets 820, 825, coil 835, keeper bar 830 and pole pieces 810-815 are secured to a mounting plate 845 with holes 847 that facilitate mounting the pickup in a guitar. The coils and magnets are protected by a cover 850 that is typically made from a plastic or nonferromagnetic metal.

The primary magnetic field distribution of the pickup 800 is generated by the magnets 820, 825, the keeper bar 835, and the pole pieces 810-815. The primary field is modified by the secondary magnets 802 and 805. The secondary magnet 802 is mounted on the upper surface of the bobbin 840 and magnetized with the direction and polarization of the arrow 855. The magnet 805 is mounted on the other side of the upper bobbin surface and magnetized with the direction and polarity of the arrow 860.

In a representative example, the primary magnetic source of the pickup 800 comprises the two fully-magnetized Alnico 2 bar magnets 820, 825 and has a maximum field strength of approximately 500 Gauss. The secondary source magnet 802 is a strip of 0.030" thick standard energy Ultramag material that is magnetized in the direction of the arrow 855. The secondary source magnet 805 is a 0.020" thick strip of Reance F65 flexible NdB material that is magnetized with the orientation and direction of the arrow 860. Both secondary source magnets are approximately 2.75" long and 0.25" wide and have field strengths at the pole surfaces that are less than 200 Gauss. In alternative embodiments, the secondary magnets may have other dimensions and one or both of the secondary source magnets may have composite structures with one or more loss elements. They may also be oriented with their fields in various directions with respect to the magnetic fields in the screw pole pieces 810-815.

The invention is further embodied in methods for changing the tone of an existing pickup by adding a secondary magnetic source to the pickup. Most conventional pickups can be easily retrofitted by attaching one or more secondary magnets to a surface of the pickup or the pickup cover. In cases where the pickup has a removable cover it may also be retrofitted by replacing it with a cover that comprises a secondary magnetic source. The secondary magnetic sources comprise a secondary magnet with a monolithic or composite structure and in some cases, include two or more magnets. Composite magnets may advantageously have a permanent magnet component that is formed from a flexible ferrite or NdB-based material. They may also have loss components that are formed from a material that comprises a granulated ferromagnetic material and an insulating binder, a hysteresis material, a soft ferromagnetic material or a nonferromagnetic conductor. Secondary magnets may be attached to a pickup using a variety of conventional adhesives, including repositionable adhesives that enable the user to easily change the secondary field configuration. Advantageously, secondary magnets may have self-adhesive, peel-and-stick surfaces to facilitate their installation by an end user.

Those skilled in the art of pickup design and manufacture will realize that the embodiments described herein are illustrative and that secondary magnetic sources may be used to modify the primary magnetic field distribution in magnetic pickups with different architectures. While the features of the invention were illustrated with secondary magnets that affected the tone of two or more strings, secondary sources according to the invention may comprise smaller magnets that are placed under individual strings to achieve a more targeted effect. Secondary sources may also comprise two or more components with different thicknesses that generate different field strengths under different strings. In alternative embodiments, secondary magnetic sources with a wide range of cross sections and field strengths are easily incorporated into most magnetic pickup designs to optimize the output tone.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A magnetic pickup for detecting the vibration of ferromagnetic strings in a musical instrument, the pickup comprising:

at least one ferromagnetic pole piece;

a wire coil that surrounds at least a portion of each pole piece;

a primary magnetic source associated with each pole piece that creates a primary magnetic field distribution in each pole piece and one or more ferromagnetic strings of a musical instrument when the pickup is mounted in the instrument;

a mounting structure that holds each pole piece and the coil in a stable relative position and enables their attachment to the stringed musical instrument; and a secondary magnetic source that modifies the primary magnetic field distribution, the secondary magnetic source having a maximum magnetic induction that is smaller than the maximum magnetic induction of the primary source and one or more components that are each spatially separated from the at least one pole piece and the primary magnetic source.

2. The magnetic pickup of claim 1 wherein the maximum magnetic induction of the secondary magnetic source is less than half of the maximum magnetic induction of the primary magnetic source.

3. The magnetic pickup of claim 1 wherein the primary magnetic source comprises two or more magnetized hard ferromagnetic pole pieces.

4. The magnetic pickup of claim 1 wherein the primary magnetic source comprises one or more primary permanent magnets that induce a magnetic field in each pole piece, the one or more primary magnets being positioned so that the coil is interposed between each of the primary permanent magnets and the strings of the musical instrument when the pickup is secured to the instrument.

5. The magnetic pickup of claim 1 wherein the secondary magnetic source comprises at least one secondary permanent magnet that is selected from the group consisting of bonded magnets and flexible magnets.

6. The magnetic pickup of claim 1 wherein the direction of a magnetic field in the at least one pole piece and the direction of a magnetic field in the secondary magnetic source are approximately parallel to a plane.

7. The magnetic pickup of claim 1 wherein the direction of the primary magnetic field in the at least one pole piece lies in a plane that is approximately orthogonal to the direction of a magnetic field in the secondary magnetic source.

8. The magnetic pickup of claim 1 wherein the secondary magnetic source comprises a first secondary permanent magnet and a second secondary permanent magnet.

9. The magnetic pickup of claim 8 wherein the magnetic field direction of the second secondary magnet is different than the magnetic field direction of the first secondary magnet.

10. The magnetic pickup of claim 1 wherein the pickup further comprises a pickup cover and the pickup cover comprises at least a portion of the secondary magnetic source.

11. A magnetic pickup for detecting the vibration of ferromagnetic strings on a musical instrument, comprising:

at least one ferromagnetic pole piece;

a primary magnetic source associated with each pole piece generates a primary magnetic field distribution in the at least one pole piece and one or more strings in a musical instrument when the pickup is mounted in the instrument;

a wire coil that surrounds at least a portion of each pole piece;

a mounting structure that secures each pole piece and the coil in a stable relative position and enables their attachment to the stringed musical instrument; and a secondary magnetic source that modifies the primary magnetic field distribution and comprises at least one composite permanent magnet having at least one magnetized hard ferromagnetic component and one or more ferromagnetic loss components.

12. The magnetic pickup of claim 11 wherein the pickup further comprises a pickup cover that comprises the at least one composite permanent magnet.

13. The magnetic pickup of claim 11 wherein the at least one magnetized hard ferromagnetic component of the at least one composite permanent magnet is selected from the group consisting of bonded permanent magnets and flexible permanent magnets.

14. The magnetic pickup of claim 11 wherein at least one of the one or more ferromagnetic loss components of the at least one composite permanent magnet comprises a granulated ferromagnetic material and an insulating binder.

15. The magnetic pickup of claim 11 wherein at least one of the one or more ferromagnetic loss components of the at least one composite permanent magnet is formed from a material that is selected from the group consisting of hysteresis materials, soft ferromagnetic materials and nonferromagnetic conductors.

16. A method of retrofitting and changing the tonal properties of a magnetic pickup for sensing the vibration of ferromagnetic strings on a musical instrument, the pickup comprising at least one ferromagnetic pole piece; a primary magnetic source associated with each pole piece that generates a primary magnetic field in each pole piece and one or more strings of a musical instrument when the pickup is mounted in the instrument; a wire coil that surrounds at least a portion of each pole piece; and a mounting structure that secures each pole piece and the coil in a stable relative position and enables their attachment to the stringed musical instrument, the method comprising:

attaching to the pickup a secondary magnetic source comprising one or more secondary permanent magnets so that the secondary magnetic source modifies a distribution of the primary magnetic field and each of the one or more secondary permanent magnets of the secondary magnetic source is spaced apart from the at least one pole piece and the primary magnetic source in a dimension that lies in a plane that is approximately parallel to an upper surface of the pickup.

17. The method of claim 16 wherein the pickup further comprises a pickup cover and at least one of the one or more secondary permanent magnets is attached to the pickup cover.

18. The method of claim 16 wherein the pickup further comprises a first pickup cover and the secondary magnetic source is attached to the pickup by replacing the first pickup cover with a second pickup cover that comprises the secondary magnetic source.

19. The method of claim 16 wherein at least one of the one or more secondary permanent magnets is a composite magnet that comprises at least one permanent magnet component and at least one ferromagnetic loss component.

20. The method of claim 19 wherein the at least one ferromagnetic loss component is formed from a material that comprises an insulating binder and a granulated ferromagnetic material.

21. The method of claim 19 wherein one or more of the at least one ferromagnetic loss component is formed from a material that is selected from the group consisting of hysteresis materials, soft ferromagnetic materials, and nonferromagnetic conductors.

22. The method of claim 16 wherein at least one of the one or more secondary permanent magnets comprises a self-adhesive surface.

23. The method of claim 16 wherein the secondary magnetic source comprises a first secondary magnet and a second secondary magnet.

* * * * *

UNITED STATES PATENT AND TRADEMARK OFFICE

CERTIFICATE OF CORRECTION

PATENT NO. : 8,969,701 B1
APPLICATION NO. : 13/829544
DATED : March 3, 2015
INVENTOR(S) : George J. Dixon It is certified that error appears in the above-identified patent and that said Letters Patent is hereby corrected as shown below:

In the Claims

Claim 11, Col. 19, line 41, "generates a primary magnetic field distribution in the at" should read -- that generates a primary magnetic field distribution in the at --

Signed and Sealed this
Ninth Day of June, 2015

Michelle K. Lee

Michelle K. Lee
*Director of the United States Patent and Trademark Office*